US010856670B2

(12) United States Patent
Gooris

(10) Patent No.: US 10,856,670 B2
(45) Date of Patent: Dec. 8, 2020

(54) FOLDABLE CHILD BOOSTER SEAT

(71) Applicant: STUDIO GOORIS LIMITED, Hong Kong (HK)

(72) Inventor: Frederic Frans Petrus Gooris, Hong Kong (HK)

(73) Assignee: Studio Gooris Limited, Hong Kong (HK)

( * ) Notice: Subject to any disclaimer, the term of this patent is extended or adjusted under 35 U.S.C. 154(b) by 0 days.

(21) Appl. No.: 16/436,932

(22) Filed: Jun. 11, 2019

(65) Prior Publication Data

US 2019/0290019 A1 Sep. 26, 2019

Related U.S. Application Data

(63) Continuation of application No. 15/553,170, filed as application No. PCT/CN2016/086206 on Jun. 17, 2016, now abandoned.

(Continued)

(51) Int. Cl.

| | |
|---|---|
| ***A47D 15/00*** | (2006.01) |
| ***A47D 1/10*** | (2006.01) |
| ***A47D 1/02*** | (2006.01) |

(52) U.S. Cl.

CPC ..... *A47D 15/006* (2013.01); *A47D 1/02* (2013.01); *A47D 1/103* (2013.01)

(58) Field of Classification Search

CPC .. A47C 5/005; A47C 4/00; A47C 4/08; A47C 4/18; A47C 4/045;

(Continued)

(56) References Cited

U.S. PATENT DOCUMENTS 3,097,016 A * 7/1963 Bigler, Jr. ..... A47K 11/06 297/440.12
3,178,227 A ‡ 4/1965 Snyder ..... A47C 5/005 229/11

(Continued)

FOREIGN PATENT DOCUMENTS

JP 3205058 U * 6/2016 ..... A47C 5/005

OTHER PUBLICATIONS

Machine translation of foreign reference JP 3205058 U, obtained from https://www.j-platpat.inpit.go.jp/ (last accessed on Apr. 7, 2020) (Year: 2020).*

(Continued)

*Primary Examiner* — Theodore V Adamos
(74) *Attorney, Agent, or Firm* — Idea Intellectual Limited; Margaret A. Burke; Sam T. Yip

(57) ABSTRACT

A foldable child booster seat based on the origami and popup technique. The booster seat is light and easy to be folded flat into a compact form for storage and transport. The foldable booster seat, comprising: a plurality of rigid substrates, each rigid substrate is interconnected to another by one or more integrated hinges or flexible parts allowing the rigid substrate to fold either inward or outward when folding up; wherein when the foldable booster seat is folded flat, the rigid substrates are stacked together; and wherein when the foldable booster seat is folded up, the rigid substrates are arranged to form the shape of a chair or stool.

19 Claims, 37 Drawing Sheets

Related U.S. Application Data

(60) Provisional application No. 62/180,618, filed on Jun. 17, 2015.

(58) Field of Classification Search
CPC ..... A47B 2220/0083; A47B 88/9412; A47B 43/00; A47B 3/002; A47D 15/006; A47D 1/02; A47D 1/103
See application file for complete search history.

(56) References Cited

U.S. PATENT DOCUMENTS 3,188,158 A * 6/1965 Oscoz Sanchez ..... A47B 3/002 312/277
RE25,936 E ‡ 12/1965 Throssel ..... A47D 1/02 297/255
3,312,503 A ‡ 4/1967 Suzuki ..... A47C 5/005 297/44
3,556,593 A * 1/1971 Speegle ..... A47C 5/005 297/440.12
3,608,916 A ‡ 9/1971 Halko ..... A47B 85/00 297/440.12
3,727,979 A ‡ 4/1973 Schier ..... A47B 3/12 126/9 A
4,118,812 A * 10/1978 Pangburn ..... A47D 15/006 5/513
4,630,861 A * 12/1986 Henschel ..... A47C 4/08 108/124
4,809,619 A * 3/1989 Piretti ..... A47B 3/00 108/115
4,813,744 A * 3/1989 Scalisi ..... A47C 5/005 297/440.12
4,841,882 A ‡ 6/1989 Ehrman ..... A47B 7/00 108/115
5,366,271 A ‡ 11/1994 Johnston ..... B60N 2/286 297/250.1
5,382,081 A * 1/1995 Henry ..... A47C 5/005 206/815
D383,636 S ‡ 9/1997 Harris ..... A47C 5/005 D6/333
5,735,423 A * 4/1998 Black ..... B65D 1/225 220/23.83
5,795,027 A * 8/1998 Howard ..... A47C 5/005 297/440.1
6,206,473 B1 ‡ 3/2001 Kondratiev ..... A47B 13/003 297/440.1
2004/0239165 A1 ‡ 12/2004 Levin ..... 297/25
2006/0278140 A1 * 12/2006 Chen ..... A47B 3/14 108/173
2007/0256610 A1 * 11/2007 Robinson ..... A47B 3/083 105/115
2009/0261643 A1 * 10/2009 Kay ..... A47C 4/20 297/335
2009/0301361 A1 * 12/2009 Hsieh ..... A47B 3/002 108/129
2010/0052385 A1 ‡ 3/2010 Martini ..... A47C 7/66 297/255
2013/0228103 A1 * 9/2013 Eveleth ..... A47B 3/08 108/115
2014/0101859 A1 ‡ 4/2014 Testa ..... A47D 1/10 5/655
2016/0220026 A1 * 8/2016 Siao ..... A47C 4/045
2016/0331140 A1 * 11/2016 Banks ..... F16F 9/02
2017/0079446 A1 * 3/2017 Bellows ..... A47C 1/02

OTHER PUBLICATIONS

European Search Report of European Patent Application No. 16811030.2 dated Dec. 12, 2018.‡

* cited by examiner
‡ imported from a related application

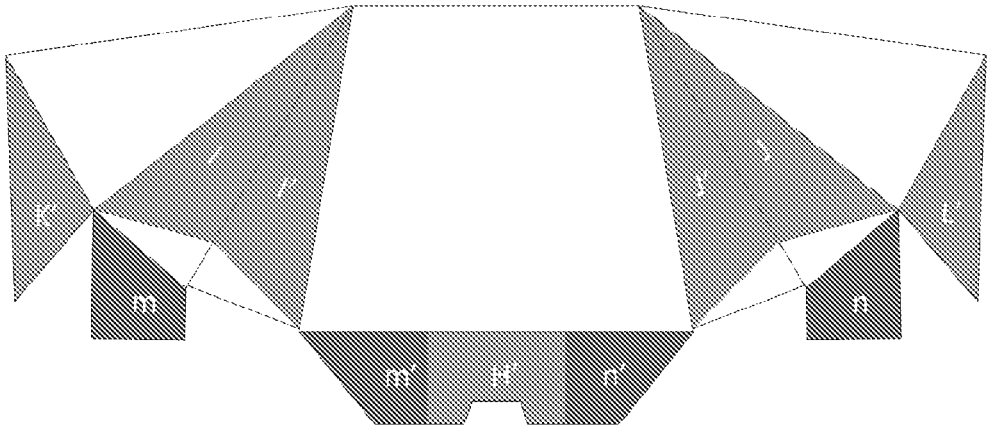
FIG. 2a (cont')

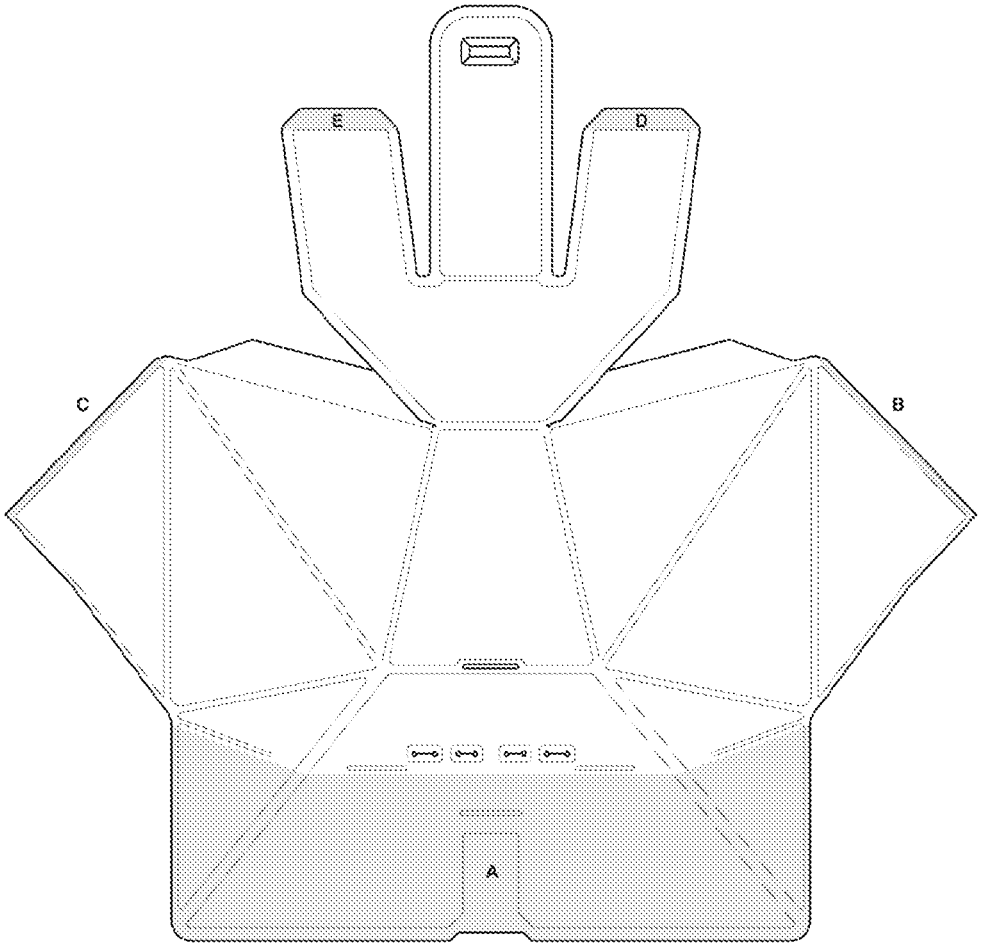
FIG. 2b (con't)

FOLDABLE CHILD BOOSTER SEAT

CROSS REFERENCE TO RELATED APPLICATION

This application is a continuation-in-part of U.S. patent application Ser. No. 15/553,170, filed 24 Aug. 2017, which is a national phase application of PCT/CN2016/086206 filed on 17 Jun. 2016 which claims priority to the U.S. Provisional Patent Application No. 62/180,618 filed on 17 Jun. 2015; the disclosures of which are incorporated herein by reference in their entirety.

FIELD OF THE INVENTION

The present invention generally relates to furniture and the manufacture thereof. More specifically, the present invention relates to self-assembling pop-up furniture including chairs, tables, and child booster seats.

BACKGROUND

Child booster seats are often used in flights, vehicles, homes, and restaurants to elevate the sitting height level of small children on adult seats and chairs. When attached to an adult-sized chair or seat, a child booster seat allows a child to sit safely, comfortably, and at the approximately same height level as a sitting adult. Child booster seats are also necessary for safety reasons, particularly in flights and vehicles where seat belts are employed to ensure the proper fastened conditions of the seat belts. Problem with existing booster seats is that they are heavy (each typically weighing 2 kg and up), bulky, not easily portable, and occupy considerable storage space when not in-use.

SUMMARY OF THE INVENTION

The present invention provides a collapsible child booster seat that addresses the problems of poor portability and stow-ability of traditional child booster seats. The booster seat in accordance to various embodiments of the present invention is based on the origami and popup technique, which is an art form of paper folding. The booster seat is light and easy to be folded flat into a compact form for storage and transport.

When laid open (before assembly), the booster seat can be viewed as one or more flat sheet materials shaped by cutout pattern(s) comprising a plurality of rigid substrates of specific shapes having flat surfaces connected by a network of integrated hinges. The shape of each of the rigid substrates and the placements of the hinges around the edges of each of the rigid substrates are designed for enabling the foldup and fold-flat actions of the assembled booster seat, and also according to the statics mechanics of the assembled booster seat.

In accordance to one embodiment, when folded flat (collapsed), the booster seat has a dimension of approximately 280 mm by 300 mm by 15 mm. Other dimensions are also possible in other embodiments. When folded up, the booster seat takes the shape of a small chair having a sitting surface and a backrest, or of a small chair having a sitting surface without any backrest or a stool.

Due to its internal double triangular structure, the weight of the occupant is transferred down to the base from both sides of the folded up booster seat and from the longitude axis of the booster seat. In an alternative embodiment, the weight is absorbed and transferred by the whole internal double triangular structure itself down to the support surface. The thicknesses, flexural, tensile, and compressive strength, and/or materials use of each individual rigid substrate can vary depending on the desired overall style, shape, and size of the folded up booster seat and for better sitting comfort, stability, sturdiness, and weight distribution.

When folded up, the chair-shape of the booster seat is upheld and secured using one or more locking means including, but not limited to, magnets or fast-release mechanical connectors.

In one embodiment, the booster seat comprises one or more built-in safety belt for securing the occupant to the booster seat. In another embodiment, the booster seat comprises one or more built-in straps for securing the booster seat to the chair or seat, or the support surface where it is placed upon.

In another aspect, the invention relates generally to support structures for self-assembling, pop-up furniture. A load-bearing surface may function as a seating surface or as the surface of a table, depending upon the selected application.

BRIEF DESCRIPTION ON THE DRAWINGS

Embodiments of the invention are described in more detail hereinafter with reference to the drawings, in which.

Figure 12:
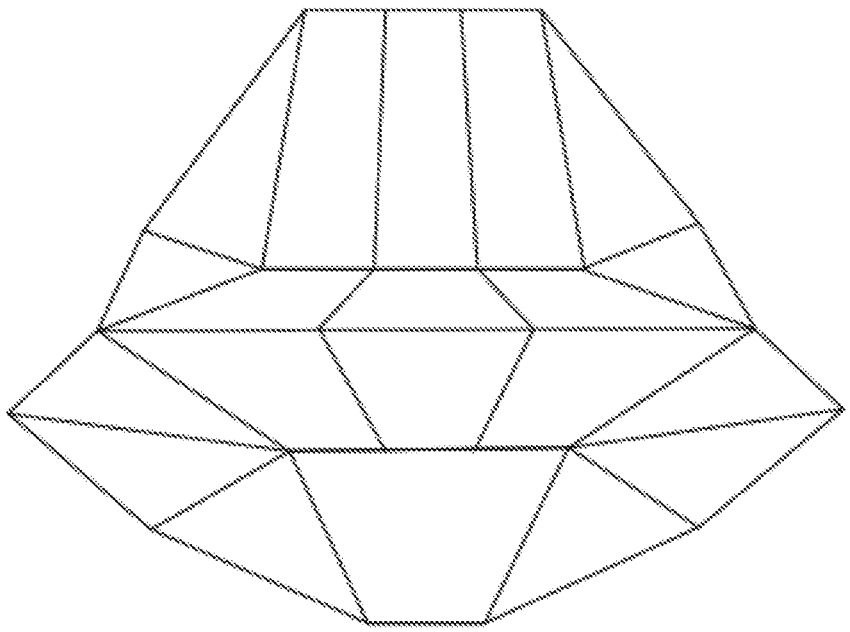
FIG. 12 shows a front view of an assembled and folded up child booster seat made of heat-pressed fiberglass in between two fabrics of a second type in accordance to another embodiment of the present invention, wherein the one fabric that is externally facing is padded.
Figure 13:
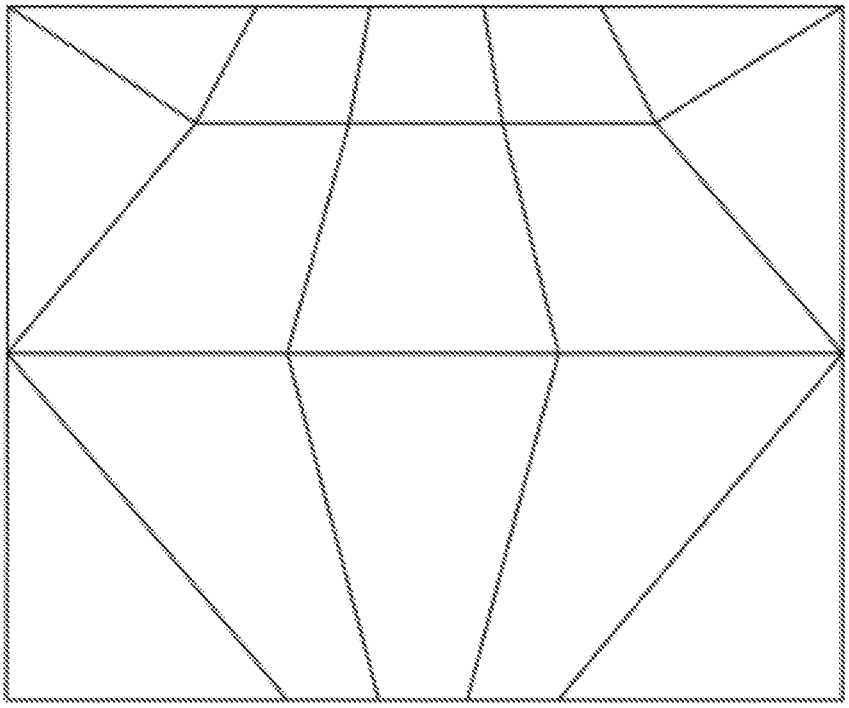
FIG. 13 shows a front view of the assembled and folded up child booster seat made of heat-pressed fiberglass in between two fabrics of the second type.
Figure 14:
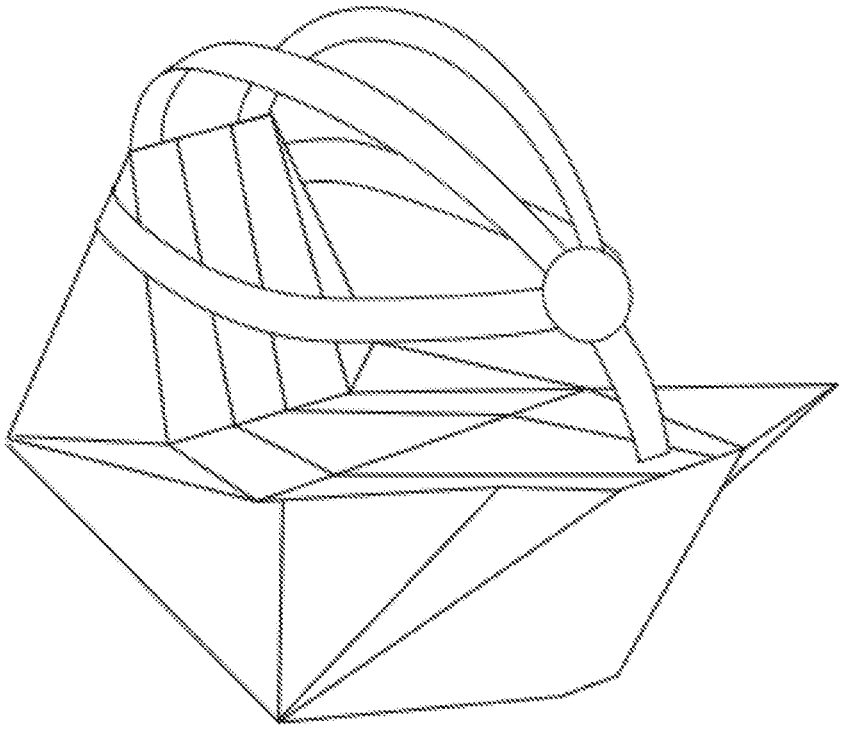
FIG. 14 shows a first perspective view of the assembled and folded up child booster seat made of heat-pressed fiberglass in between two fabrics of the second type installed with optional safety belt.
Figure 15:
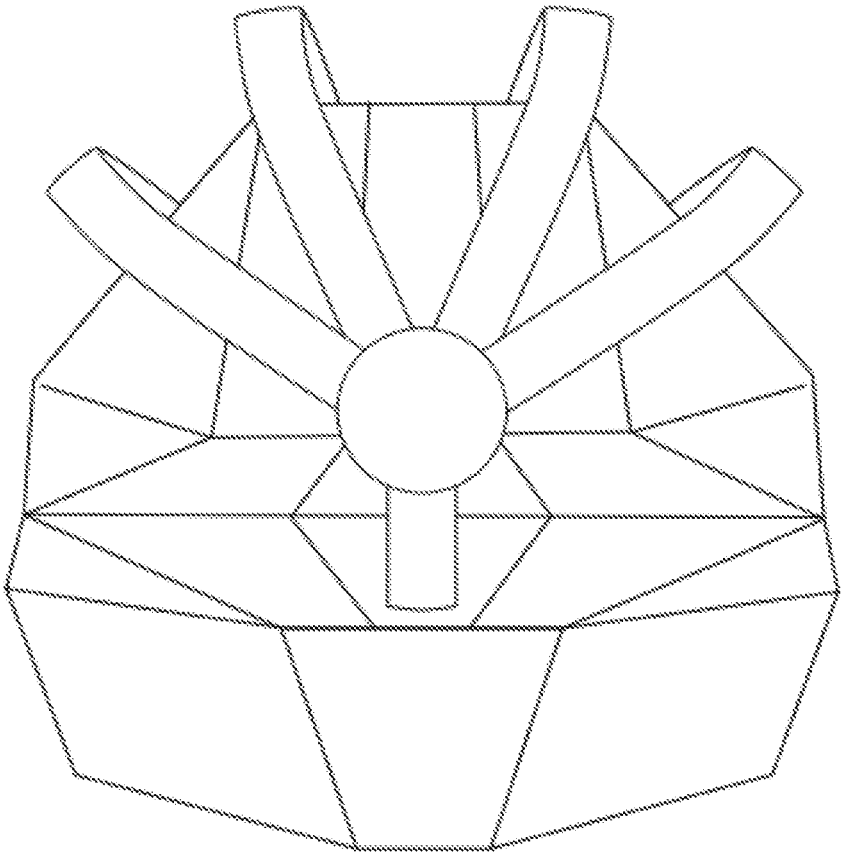
FIG. 15 shows a front view of the assembled and folded up child booster seat made of heat-pressed fiberglass in between two fabrics of the second type installed with optional safety belt.
Figure 16:
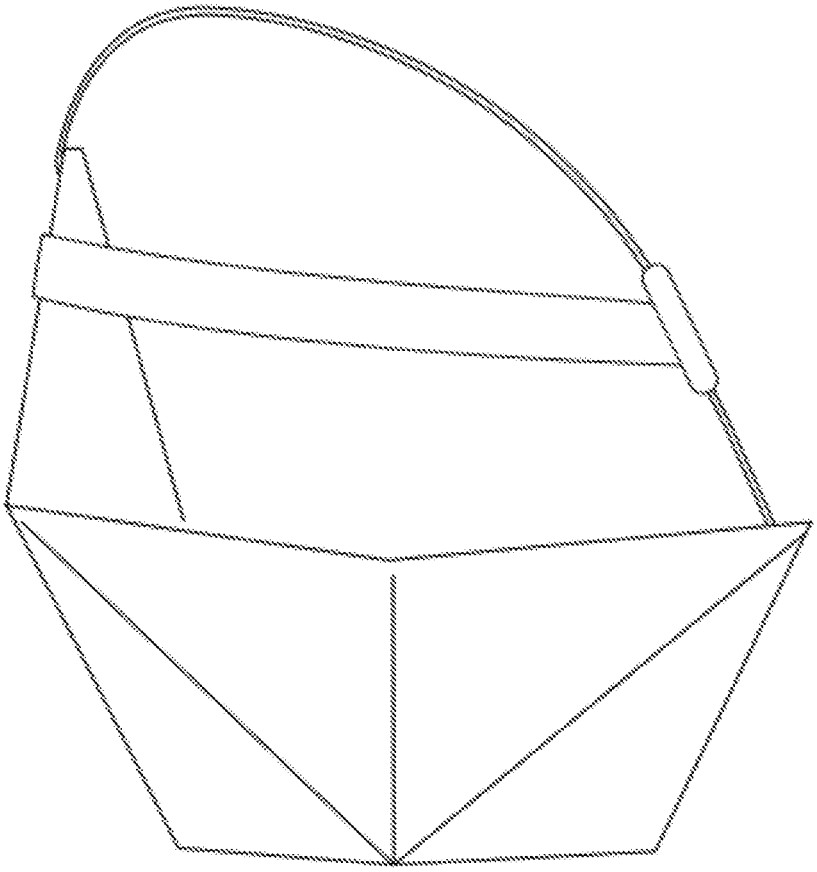
FIG. 16 shows a side view of the assembled and folded up child booster seat made of heat-pressed fiberglass in between two fabrics of the second type installed with optional safety belt.
Figure 17:
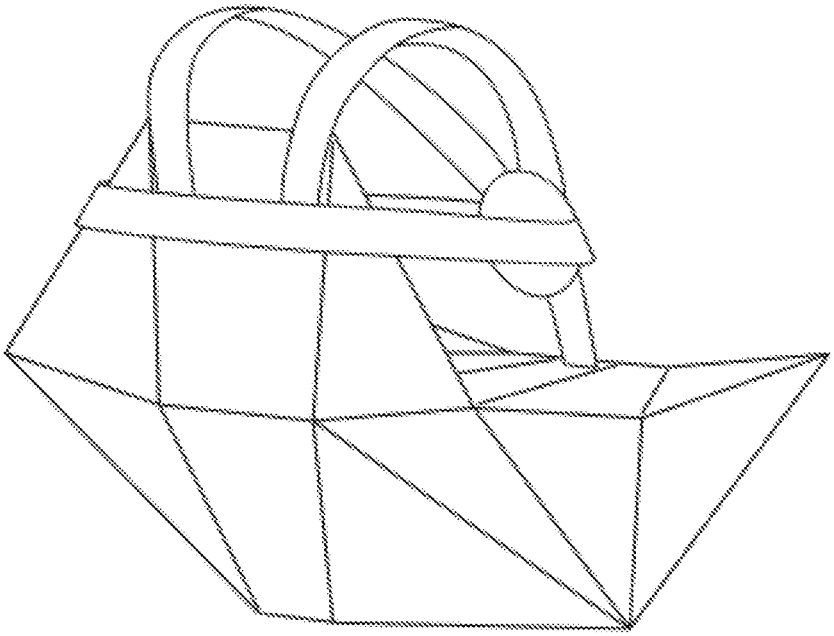
FIG. 17 shows a second perspective view of the assembled and folded up child booster seat made of heat-pressed fiberglass in between two fabrics of the second type installed with optional safety belt.

FIGS. 20A-20E demonstrate the side view of the pop-up assembly of the child booster seat of FIGS. 3-9/FIGS. 12-14 as the seat gradually opens from a folded to a fully-assembled state.

FIGS. 21A-21E demonstrate the front view of the pop-up assembly of the child booster seat of FIGS. 3-9/FIGS. 12-14 as the seat gradually opens from a folded to a fully-assembled state.

FIGS. 22A-22F demonstrate a cross-sectional view of the pop-up assembly of the child booster seat of FIGS. 3-9/FIGS. 12-14.

Figure 3:
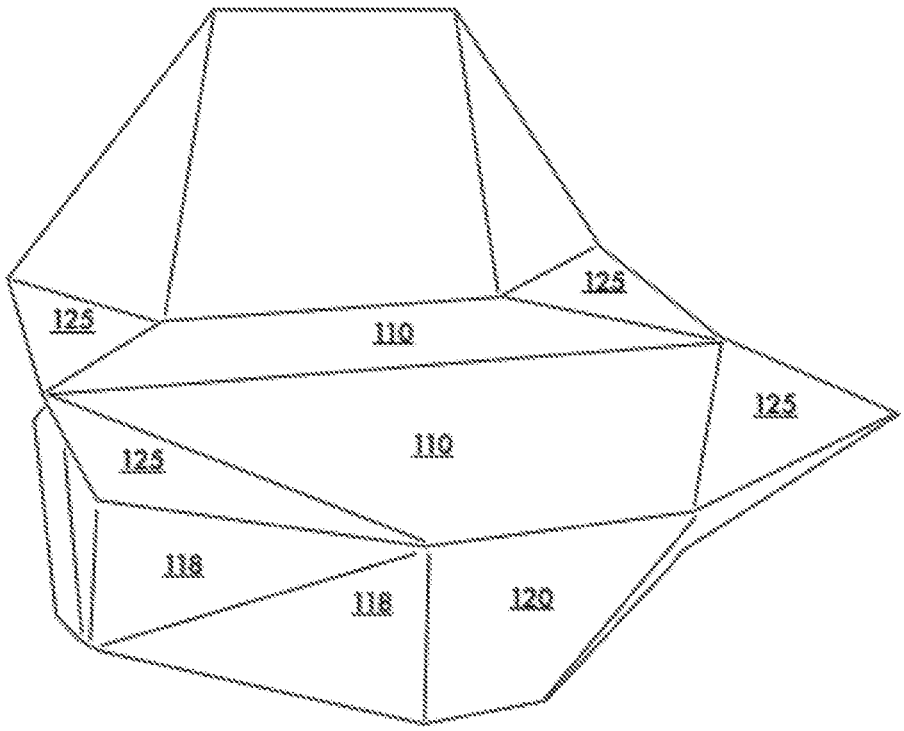
FIG. 3 shows a perspective view of an assembled and folded up child booster seat in accordance to one embodiment of the present invention.
Figure 4:
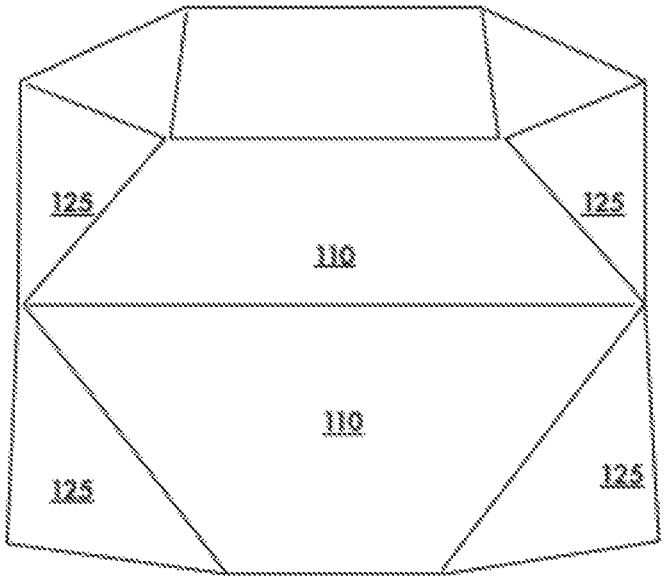
FIG. 4 shows a top view of the assembled and folded up child booster.
Figure 23:
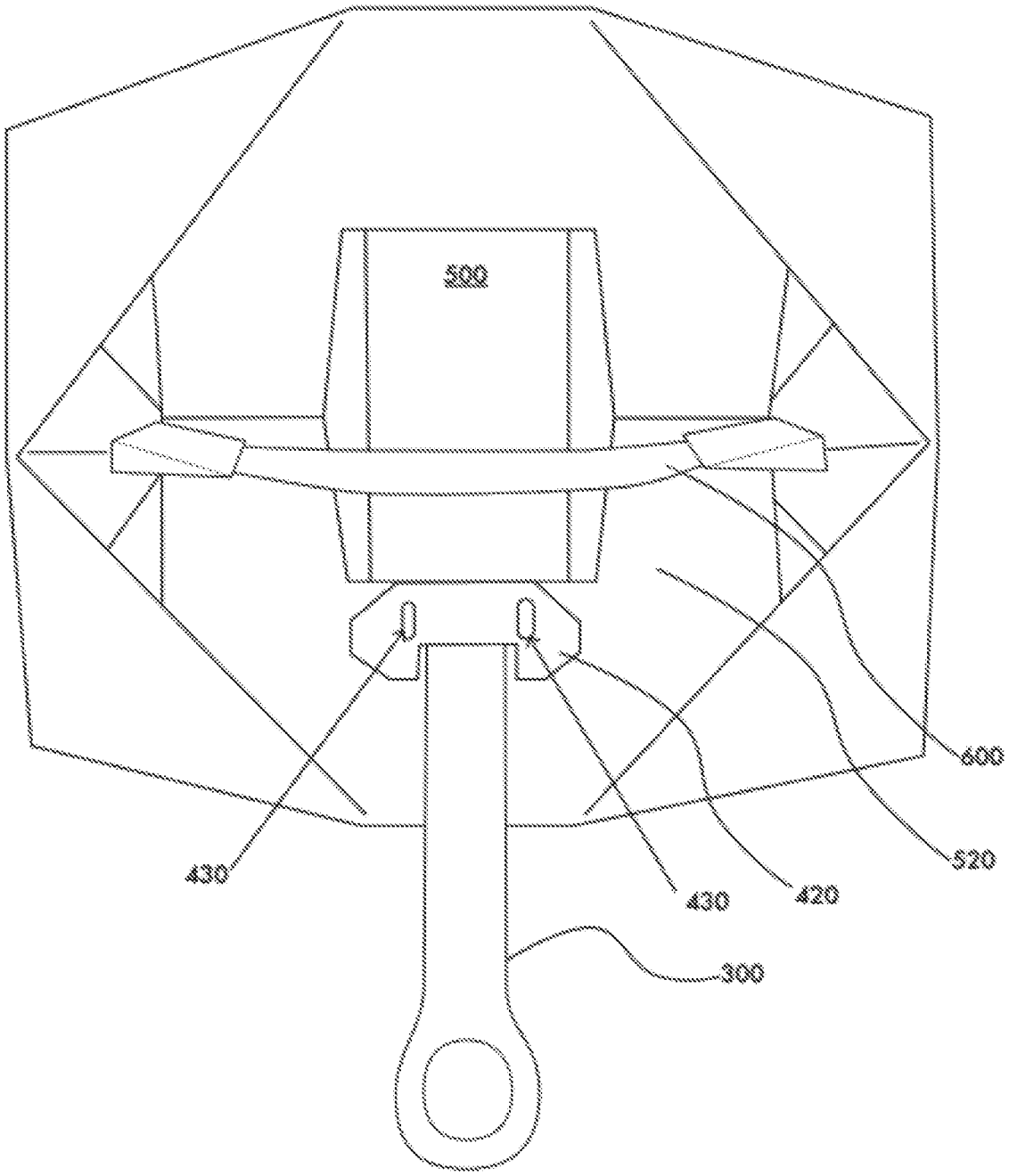

FIG. 23 depicts a bottom view of the open booster seat of FIG. 3.

DETAILED DESCRIPTION OF THE INVENTION

In the following description, product models and methods of manufacture of child booster seat are set forth as preferred examples. It will be apparent to those skilled in the art that modifications, including additions and/or substitutions may be made without departing from the scope and spirit of the invention. Specific details may be omitted so as not to obscure the invention; however, the disclosure is written to enable one skilled in the art to practice the teachings herein without undue experimentation.

The booster seat in accordance to various embodiments of the present invention is based on the origami and popup technique, which is an art form of paper folding. The booster seat is light and easy to be folded into a compact form for storage and transport.

When laid open (before assembly), the booster seat can be viewed as one or more flat sheet materials shaped by cutout pattern(s) comprising a plurality of rigid substrates of specific shapes having flat surfaces connected by a network of integrated hinges. The shape of each of the rigid substrates and the placements of the hinges around the edges of each of the rigid substrates are designed specifically for enabling the foldup and fold-flat actions of the assembled booster seat, and also according to the statics mechanics of the assembled booster seat. The manufacture of the booster seat can be achieved through many different ways including, but not limited to:

1. Using plastic (e.g. polypropylene) molding or injection techniques in making a single variable composite material board with defined thicker areas for the rigid substrates and defined thinner areas for the hinges;
2. Permanently binding (e.g. by heat-pressing or ultrasound welding) soft plastic and/or rubber strips (for the hinges) to hard plastic or fiberglass panels (for the rigid substrates);
3. Attaching (e.g. by glue or overmolding) the rigid substrates made of (e.g. hard plastic or fiberglass) onto a layer of fabric;
4. Sealing and sandwiching (e.g. by heat-pressing) rigid substrates made of (e.g. hard plastic, fiberglass, or other hard composite material) in between two layers of fabric, and removing the inserts in defined areas for the hinges;
5. Using a single piece of carbon fiber and applying resin onto the carbon fabric areas needed to be polymerized for the rigid substrates;
6. Applying hardening treatment (e.g. thermal treatment) onto defined areas of a single piece of synthetic fabric to create the rigid substrates; or
7. Using any other technique that combines hard panels with flat surfaces (for the rigid substrates) with mechanical hinges or soft material members (for the hinges).

Figure 1:
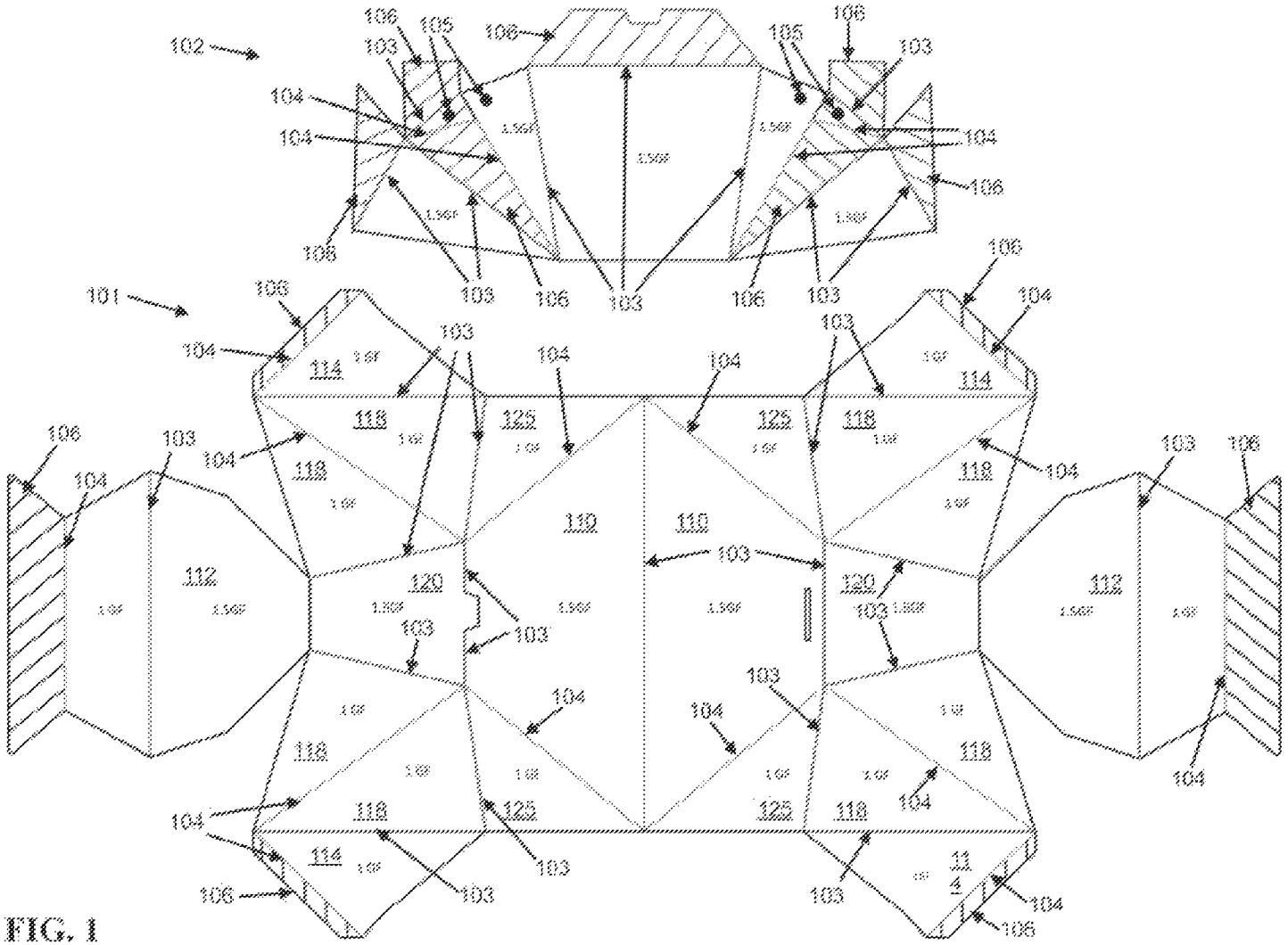
FIG. 1 depicts the sheet material cutout patterns of the child booster seat in accordance to an embodiment of the present invention.
Figure 5:
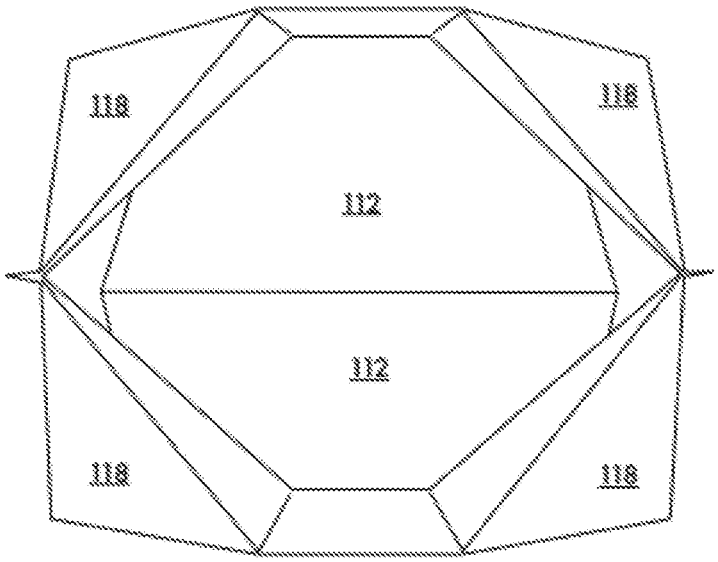
FIG. 5 shows a bottom view of the assembled and folded up child booster seat.
Figure 6:
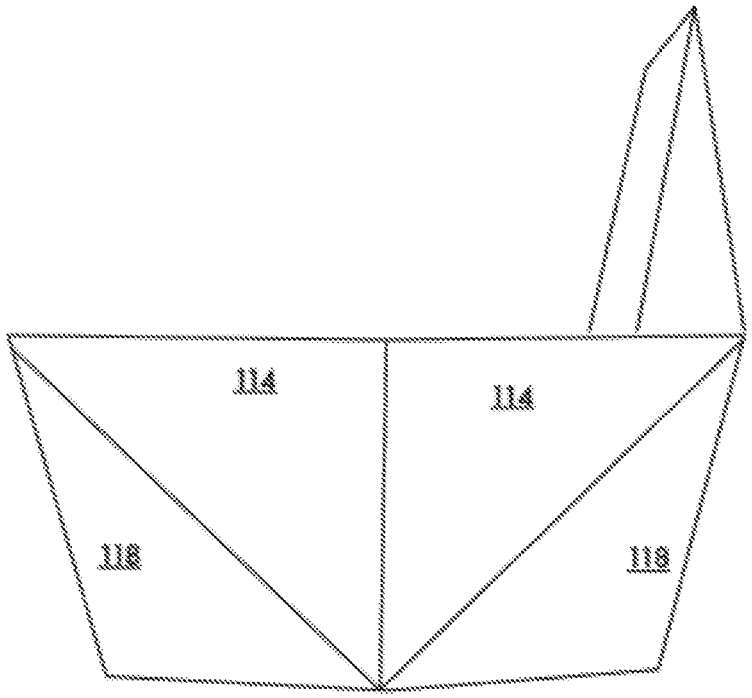
FIG. 6 shows a side view of the assembled and folded up child booster seat.
Figure 7:
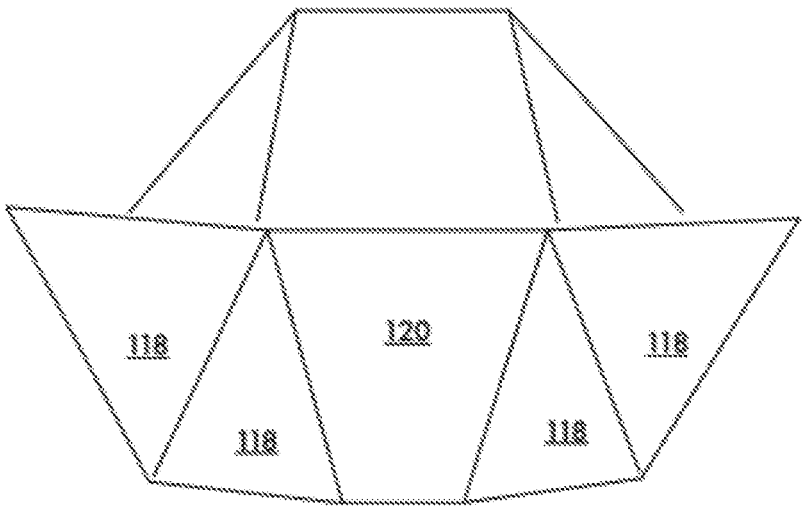
FIG. 7 shows a front view of the assembled and folded up child booster seat.
Figure 8:
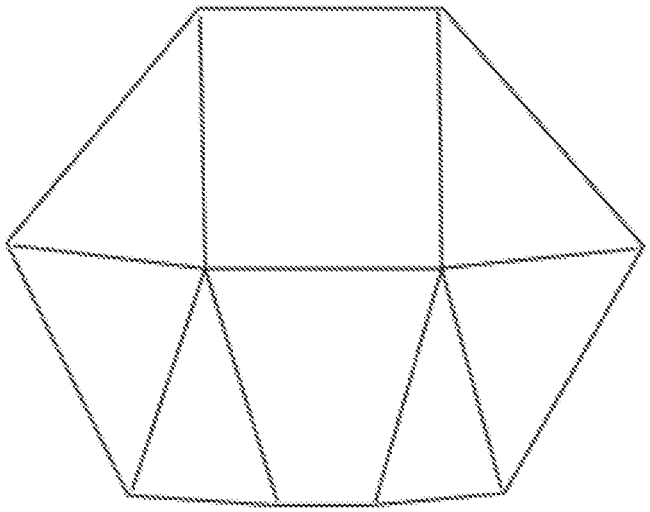
FIG. 8 shows a back view of the assembled and folded up child booster seat.

Referring to FIG. 1. FIG. 1 depicts the sheet material cutout patterns of a child booster seat in accordance to an embodiment of the present invention. Sub-pattern 101 is the sheet material cutout pattern of the main body of the child booster seat. Sub-pattern 102 is the sheet material cutout pattern of the backrest of the child booster seat to be attached to the main body of the child booster once assembled. The integrated hinges are located on edges 103 and 104 in between the rigid substrates. Trapezoidal shapes 110 form a portion of a sitting surface as seen in FIG. 3, while shapes 112 form a portion of a base/internal support structure as shown in FIG. 5. Triangular shapes 114 form side panels that uphold the sitting surface, as seen in FIG. 6, while trapezoidal shapes 120 are supports for the sitting surface as seen in FIGS. 3 and 7. Triangular shapes 118 are linking panels that connect triangular support side panels 114 and trapezoidal support 120. Triangular shapes 125 share a hinge 103 with the linking panels 118, connecting trapezoidal shapes 110 to triangular linking panels 118. When the booster seat is assembled, as seen in FIGS. 3-7, the trapezoidal support 120 and the triangular support side panel 114 position the sitting surface/load-bearing surface 110 at a distance above the base/internal support structure 112. Each of the hinges on edges 103 allows the two rigid substrates connected by the hinge to fold inward during the foldup action of the child booster seat. Each of the hinges on edges 104, on the other hand, allows the two rigid substrates connected by the hinge to fold outward during the foldup action of the child booster seat. Magnets or other snap attachment means, such as straps, are fixed at circles 105 for holding together the rigid substrates on which the magnets or other snap attachment means are fixed on. This functions as a locking mechanism to uphold the foldup condition of the child booster seat. The shaded areas 106 are to bind to the surface areas of specific rigid substrates so to uphold the assembled child booster seat.

Figure 2A:
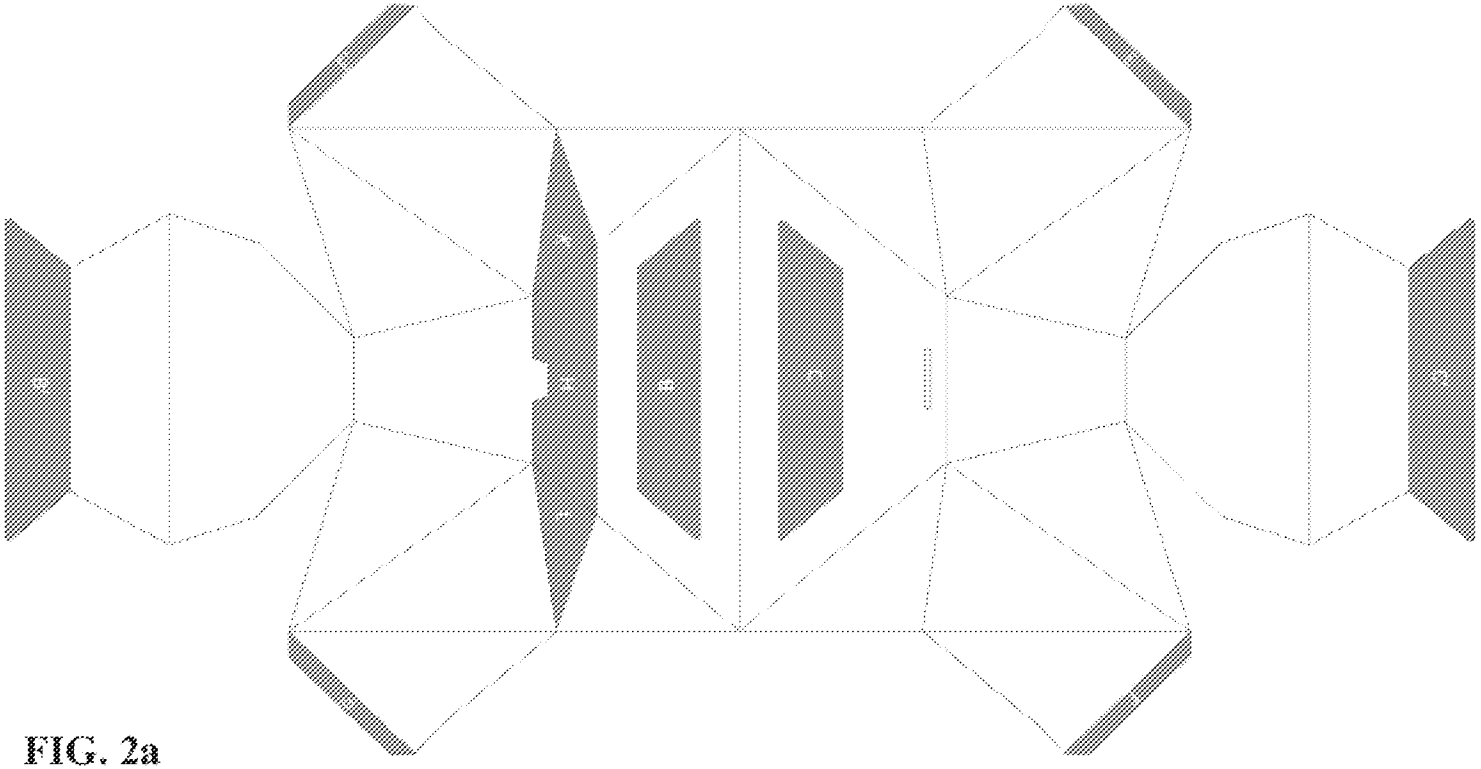
FIG. 2 depicts the sheet material cutout patterns of the child booster seat with references to the binding areas.
Figure 2B:
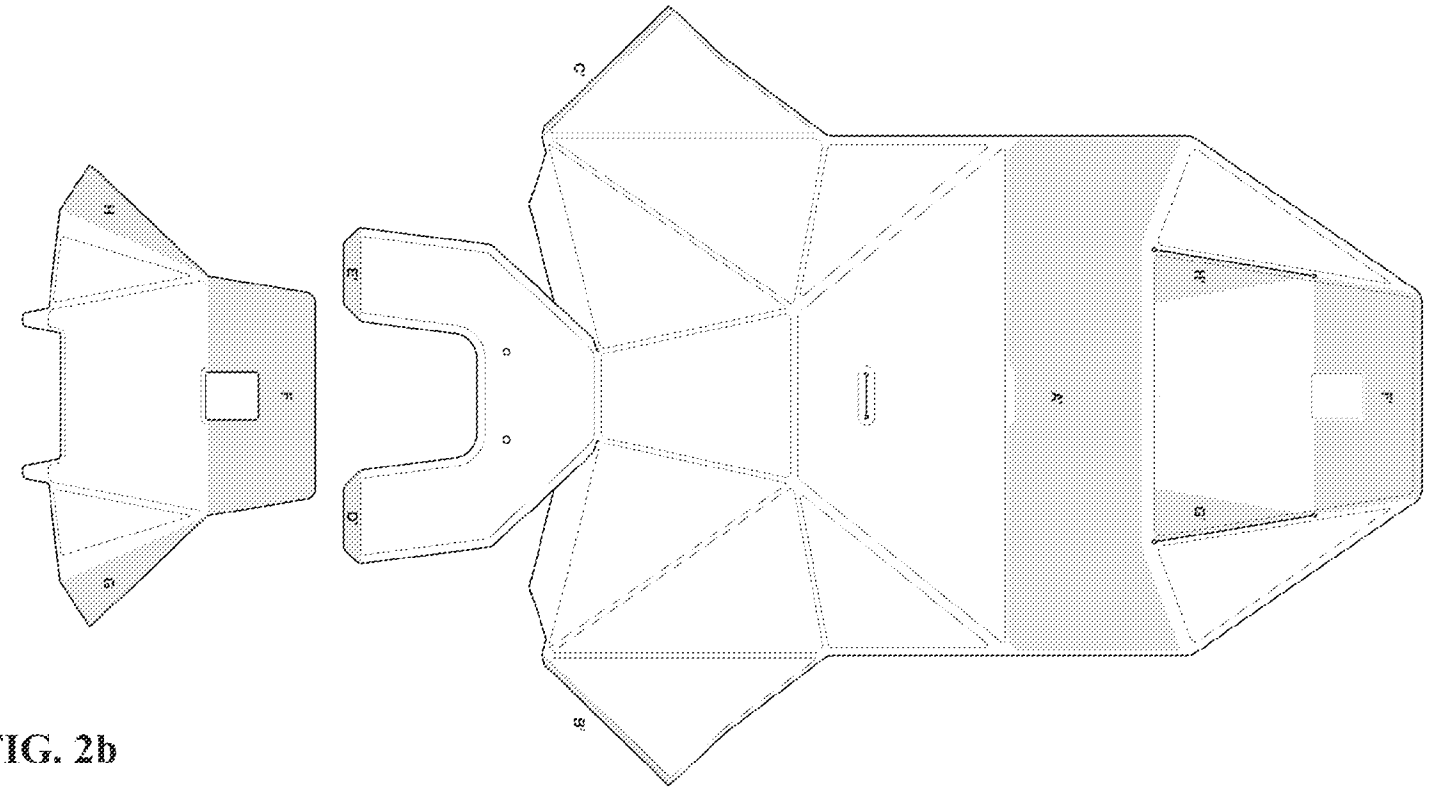

FIG. 2 shows more clearly the binding areas on the sheet material cutout patterns of the child booster seat. Binding area A' is to bind with binding area A, B' to B, C' to C, E' to E, F' to F, H' to H, I' to I, J' to J, K' to K, L' to L, m' to m, and n' to n.

In accordance to one embodiment, when folded flat (collapsed), the booster seat has a dimension of approximately 280 mm by 300 mm by 15 mm. Other dimensions are also possible in other embodiments. When folded up, the booster seat takes the shape of a small chair having a sitting surface and an optional backrest, or of a small chair having a sitting surface without any backrest or a stool.

Due to its internal double triangular structure, the weight of the occupant is transferred down to the base from both sides of the folded up booster seat and from the longitude axis of the booster seat. In an alternative embodiment, the weight is absorbed and transferred by the whole internal double triangular structure itself down to the support surface. The thicknesses, flexural, tensile, and compressive strength, and/or materials use of each individual rigid substrate can vary depending on the desired overall style, shape, and size of the folded up booster seat and for better sitting comfort, stability, sturdiness, and weight distribution.

When folded up, the chair-shape of the booster seat is upheld and secured using one or more locking means including, but not limited to, magnets or fast-release mechanical connectors.

Figure 18:
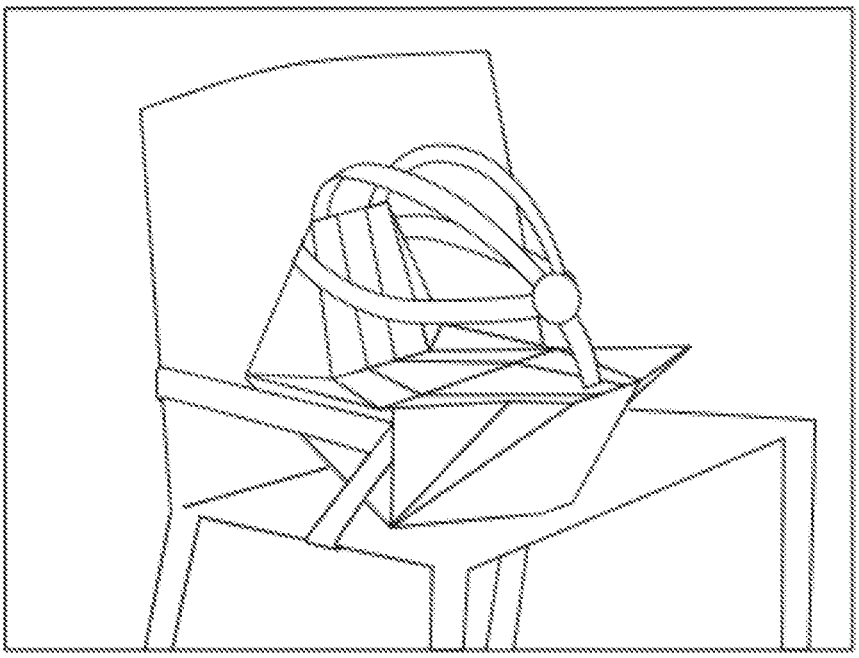
FIG. 18 shows a perspective view of the assembled and folded up child booster seat made of heat-pressed fiberglass in between two fabrics of the second type installed with optional safety belt and security straps in accordance to one embodiment of the present invention, wherein the child booster seat is secured to a chair by the security straps.
Figure 19:
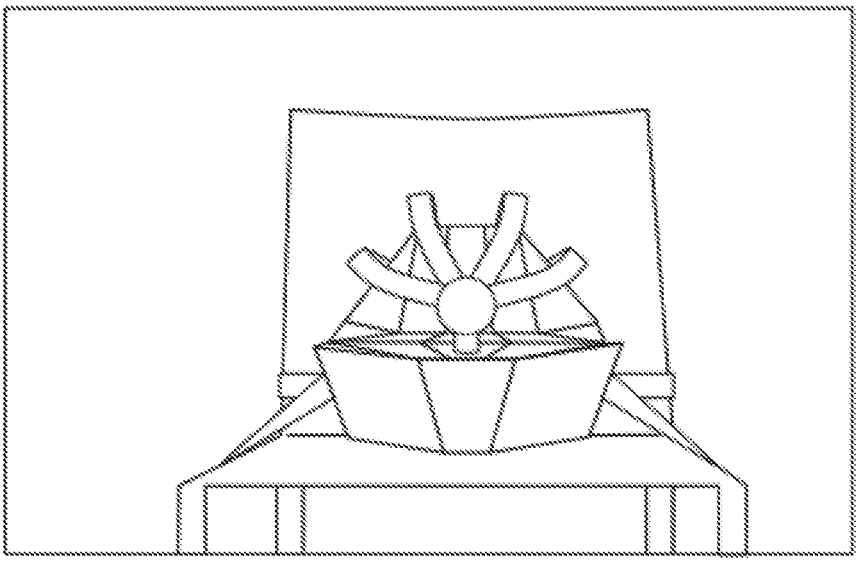
FIG. 19 shows a front view of the assembled and folded up child booster seat made of heat-pressed fiberglass in between two fabrics of the second type installed with optional safety belt and security straps, wherein the child booster seat is secured to a chair by the security straps.

In one embodiment, the booster seat comprises one or more optional built-in safety belt for securing the occupant to the booster seat as shown in FIGS. 14-17. The booster seat may optionally comprise one or more built-in straps for securing the booster seat to the chair or seat, or the support surface where it is placed upon as shown in FIGS. 18-19.

The main advantage of the present invention is that the combination of structural strength, lightweight, and its ability to be folded flat and thin allow the child booster seat to fit in almost any carrying bag, giving it great portability and making it an ideal space saving solution. A test model made of 1.4 mm thick cardboard with adhesive tape can withstand the weight of an average adult. Another test model made of heat-pressed fiberglass in between two padded fabric as shown in FIGS. 12-13 has a folded flat dimension of 280 mm by 300 mm by 18 mm and weight range of 600 g to 800 g.

A practitioner skilled in the art should appreciate that the style, shape, and size of a folded up child booster seat in accordance to the present invention are heavily influenced by the design of the sheet material cutout pattern that dictate the number, sizes, and shapes of the rigid substrates and the placements of the integrated hinges around edges of the rigid substrates. As such, many different booster seat styles, shapes, and sizes are realizable by different sheet material cutout patterns. A practitioner skilled in the art should also appreciate that different designs of the sheet material cutout pattern can be used to assemble different types of furniture such as play furniture, high chair, bed, stroller, and bouncer for toddlers and infants.

In another aspect, the present invention provides support structures for self-assembling pop-up furniture. The expression "self-assembling," as used herein, means that the furniture transforms from a folded state to a three-dimensional state without the need for the user to assemble the furniture. That is, the furniture, when folded, may be a single piece, folded object. When actuated, the folded furniture "pops-up," that is, "self-assembles" into a fully-functional, three-dimensional item of furniture. The basic unit of this furniture is a load-bearing surface (e.g., a surface that may, for example, be used as a seating surface or as a table surface) supported by one or more support structures. Turning to FIGS. 20A-20D, the relation of the load-bearing surface and the support structures is illustrated in detail as the child booster seat of FIGS. 2-9 and 12-14 self-assembles, using an optional actuator, from a collapsed, folded state to an assembled, three-dimensional "pop-up" state, ready to be employed by a user.

Figure 9:
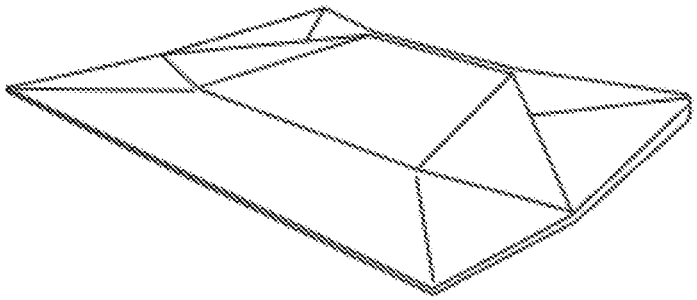
FIG. 9 shows a perspective view of the assembled and folded flat child booster seat.
Figure 10:
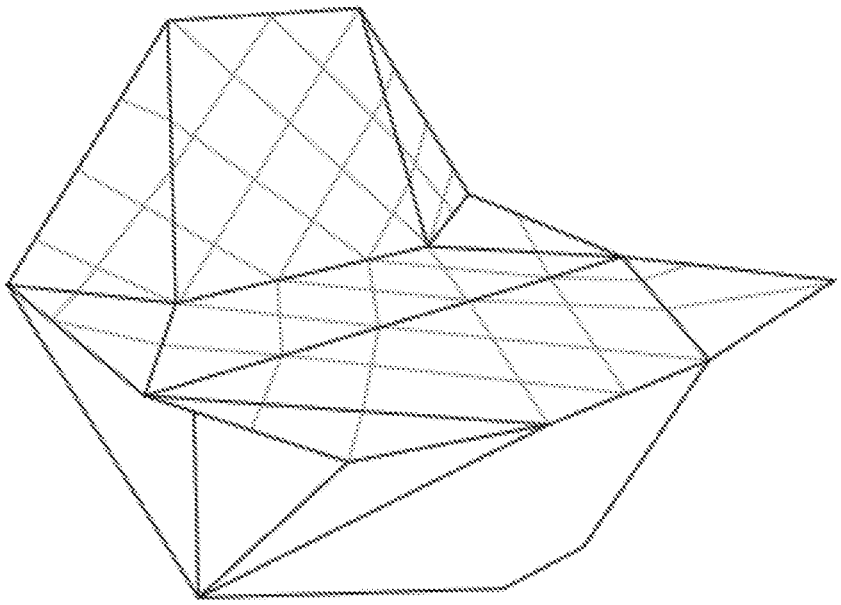
FIG. 10 shows a perspective view of an assembled and folded up child booster seat made of heat-pressed fiberglass in between two fabrics of a first type in accordance to one embodiment of the present invention, wherein the one fabric that is externally facing is padded.
Figure 11:
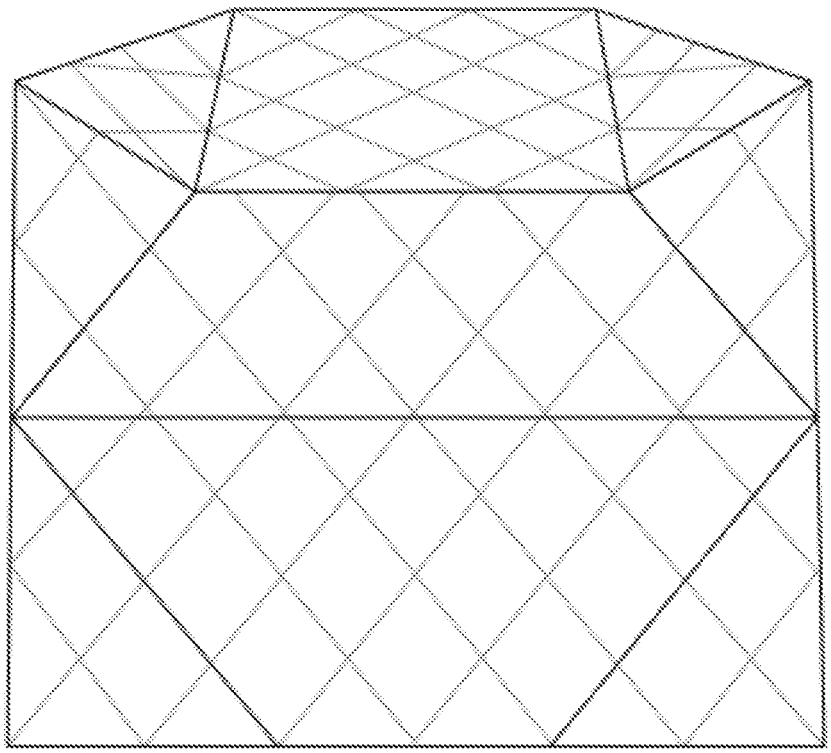
FIG. 11 shows a top view of the assembled and folded up child booster seat made of heat-pressed fiberglass in between two fabrics of the first type.
Figure 20A:
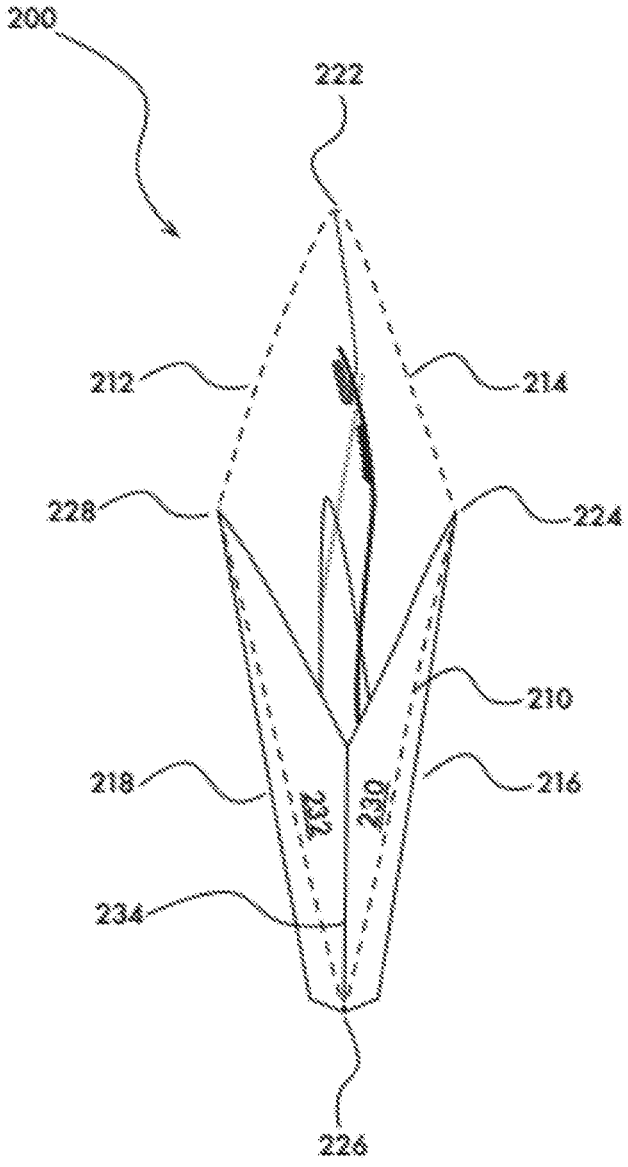

As seen in FIG. 20A, the structure 200 is in a folded, collapsed state (note that the state shown in FIG. 20A is not fully collapsed to better depict the elements of the structure. FIG. 9 depicts a fully collapsed state). It includes a collapsed quadrilateral, indicated by the dashed lines 210. Note that the described shapes are the shape of the structure in cross-section only. When formed into a fully three-dimensional structure, each of the sides that form the quadrilateral in cross-section may include further geometric features that increase the load-bearing capacity of the structure, as will be discussed in more detail below. The collapsed quadrilateral of FIG. 20A includes four quadrilateral sides in cross-section 212, 214, 216, and 218. Each pair of adjacent quadrilateral side is connected by a flexible hinge, with four flexible hinges 222, 224, 226, and 228 depicted in FIG. 20A.

Although not shown in FIGS. 21A-21E, the cross sectional configuration of these drawings is substantially similar on the opposite side of the seat.

As further seen in FIG. 20A, a pair of triangular-shaped support structures 230, 232 is provided that, when in a folded shape, substantially face each other as the triangular supports 230, 232 share a common, hinged side 234. While the depicted folded structure shows the triangular supports 230 and 232 folding inwardly, they can optionally fold outwardly. Note that triangular supports 230 and 232 each include a common side with the collapsible quadrilateral. For triangular support 230, this common side is 216 and for triangular support 232 this common side is 218. The common sides include flexible hinges along the length of each side such that the triangular supports can fold inwardly or outwardly with respect to the respective quadrilateral edge.

Figure 20B:
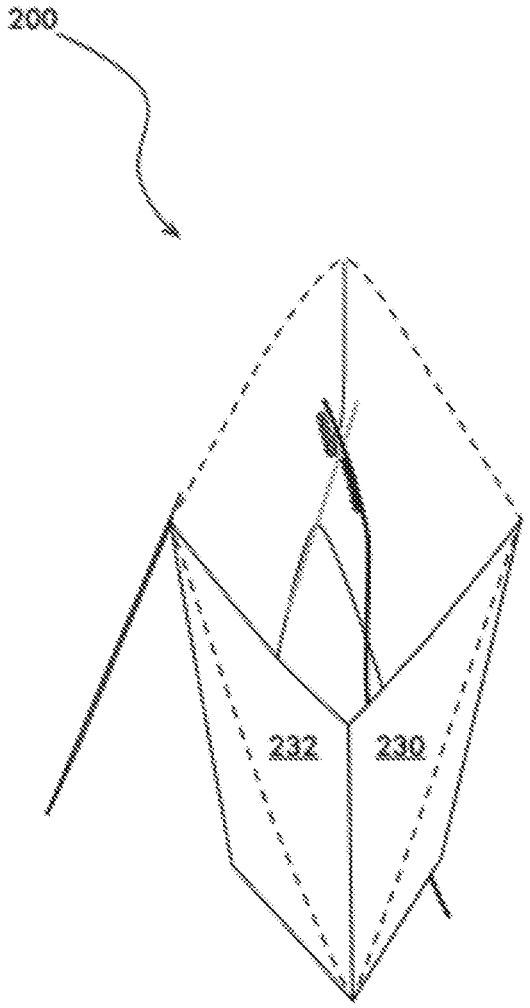

In FIG. 20B, the formerly collapsed structure has been partially opened. As seen in FIG. 20B, during opening, the triangular supports 230 and 232 gradually unfold towards an ultimate position where the support faces will be approximately perpendicular to the sides of the quadrilateral.

Figure 20C:
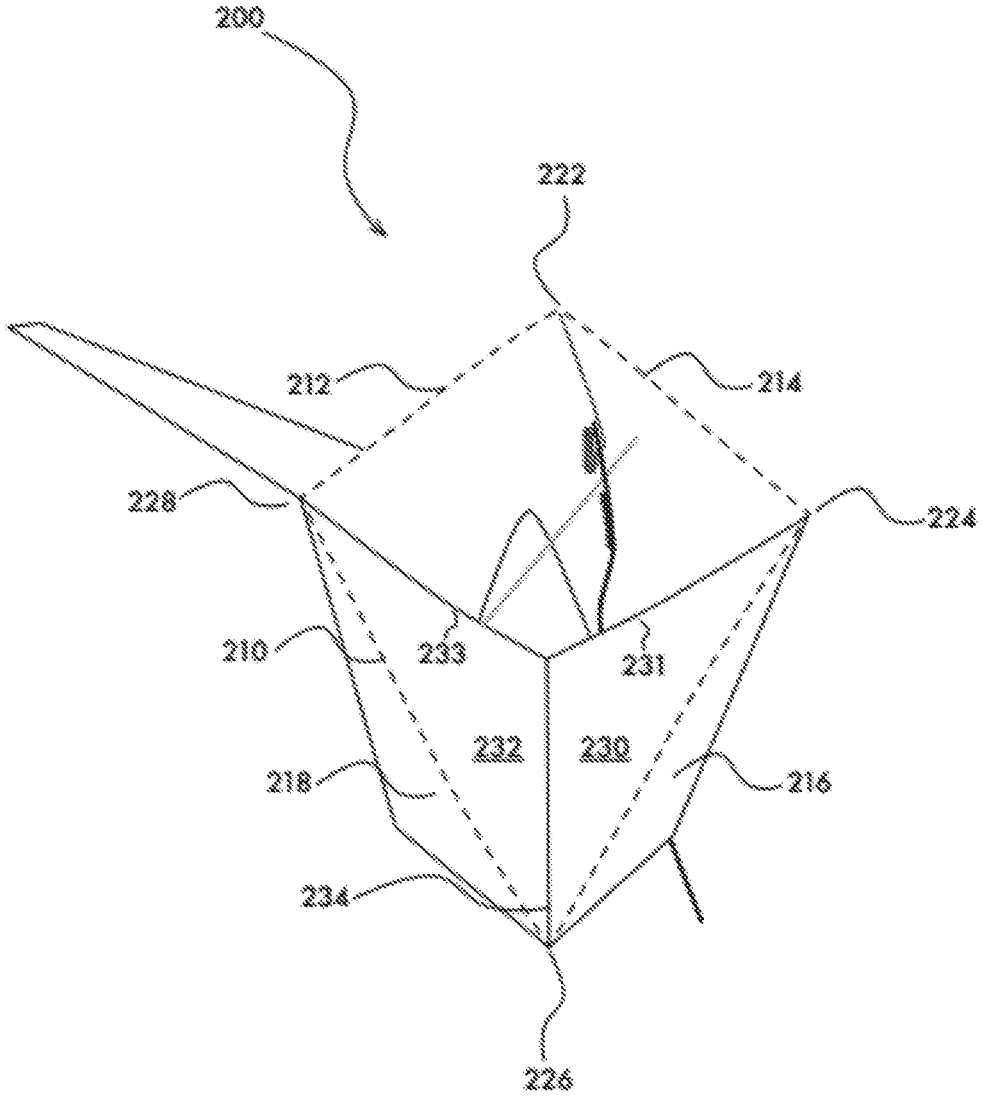
Figure 20D:
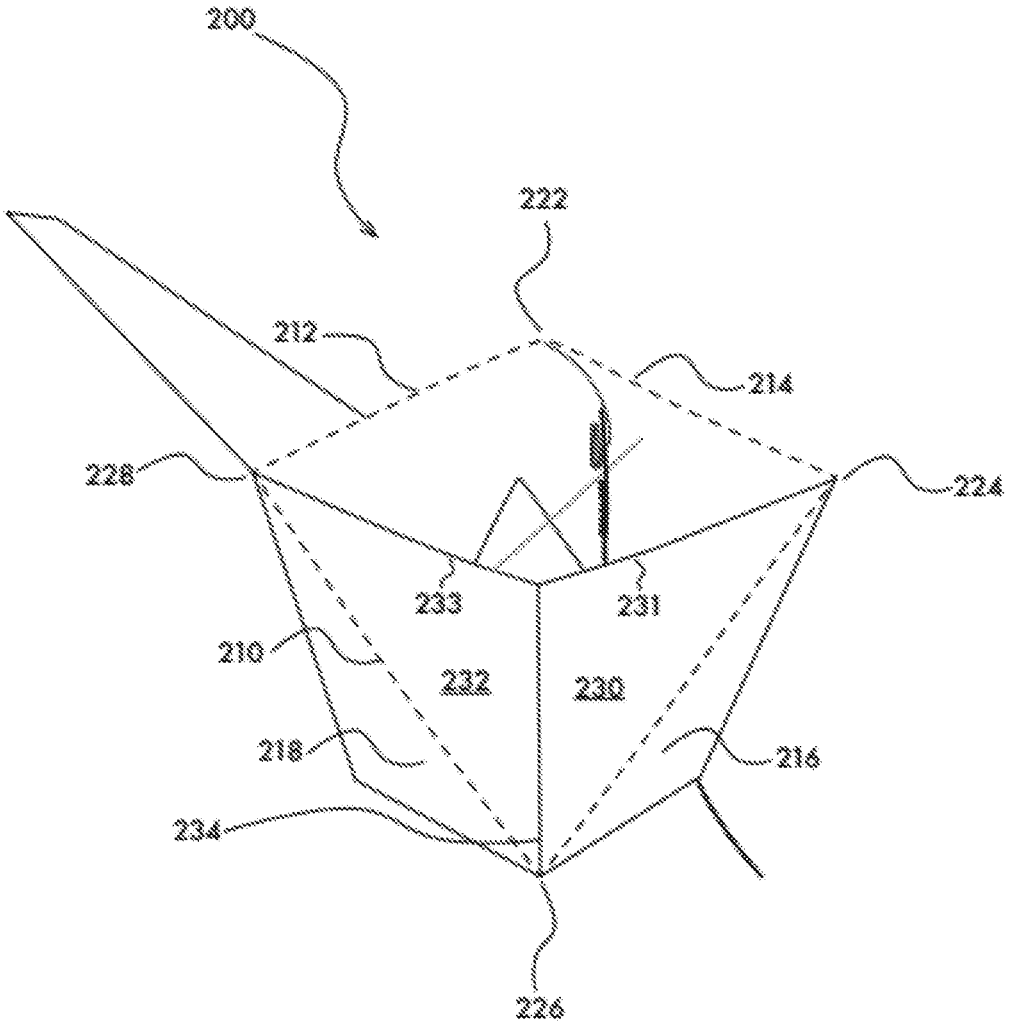
Figure 20E:
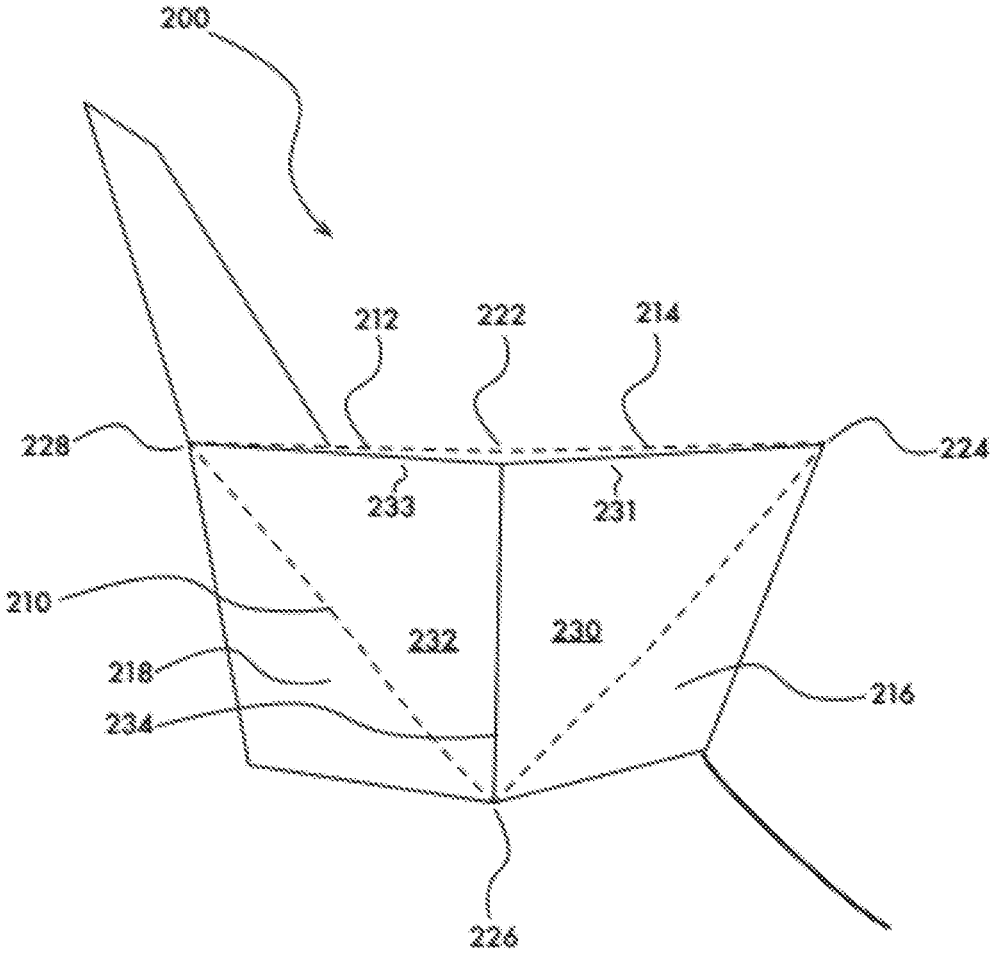

FIGS. 20C-20D depicts the further opening/assembly of the booster seat. Triangular support 230 includes top edge 231 while triangular support 232 includes top edge 233. Top edges 231 and 233 will, in use, help support the load-bearing surface FIG. 20E depicts the fully-assembled seat. The dashed line 210 shows that the initial quadrilateral shape has been transformed into an approximately triangular structure formed. Quadrilateral sides 212, and 214 have been extended outward via flexible hinge 222 to form one side of an isosceles triangle with triangular support 232 external edge 218 and triangular support 230 external edge 216 forming the other two sides of the structural support triangle. As seen in FIG. 20E, the triangle, formed from the quadrilateral shape, includes a vertex at hinge point 226 which faces a support surface below such as a chair or a floor; the vertex is opposite to the single triangle side formed by quadrilateral sides 212 and 214.

Note that the various support shapes may have different configurations such as quadrilaterals including rectangles and squares. The selection of a particular shape relates to how it can fold together with other shapes in the structure which in turn relates to the selection of the other shapes that form the foldable furniture. As long as the load-bearing surface can be supported by the support structures, the shape is usable in the foldable furniture configuration.

Figure 21A:
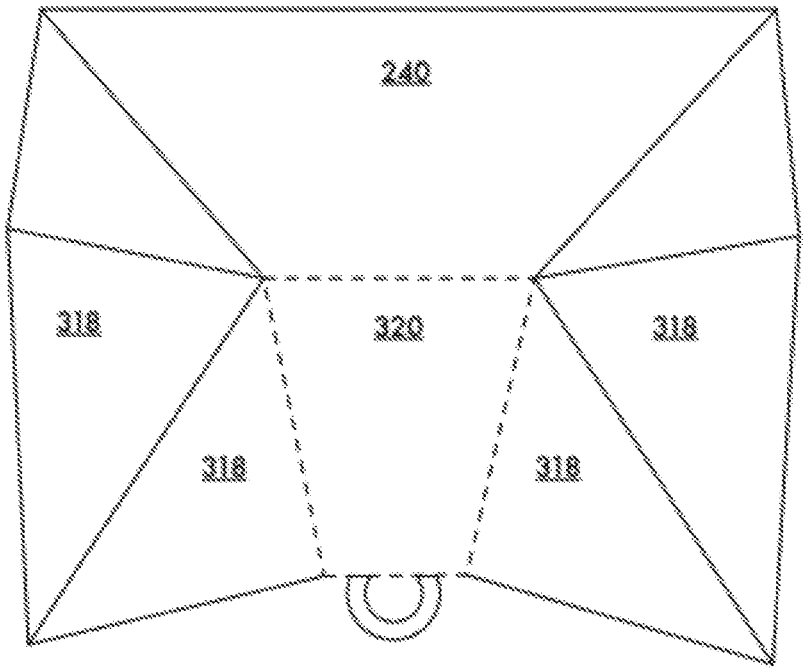

FIGS. 21A-21E depict the relation of the load-bearing surface to support structures for the child booster seat of FIGS. 2-9 and 12-14 from the front view as the structure self-assembles from a collapsed, folded state to an assembled, three-dimensional "pop-up" state, ready to be employed by a user. In FIG. 21A, half of a load-bearing surface 240 is depicted. A substantially similar second half of a load-bearing surface is folded behind surface 240. A trapezoidal front support 320 (corresponding to element 120 of FIG. 3) is illustrated in dashed lines along with linking panels 318. Note that although this shape is depicted as a trapezoid, other quadrilateral shapes also may be used. A total of four linking panels 318 is depicted, with a pair of linking panels on each side. These linking panels correspond to linking panels 118 described above. One linking panel shares a common side with triangular support 232 while the other linking panel shares a common side with a triangular support on the opposite side (not shown). These are the triangular supports that support the load-bearing surface on the side of the booster seat, described in detail above. As seen in the successive views of FIGS. 21B-21D, as element 240 is lowered into place to form a portion of the load-bearing surface, trapezoid 240 is pushed outward and the linking panels angle inward, helping to strengthen and position triangular supports 230 and 232 on the side of the structure.

In the embodiment shown, support surface 240 will form a seat portion of the booster seat but, alternatively, could be a load-bearing surface in other furniture configurations (such as a table top). Support surface 240 includes quadrilateral side 212 while support surface 242 includes quadrilateral side 214 as shown in FIGS. 20A-20E.

Figure 21B:
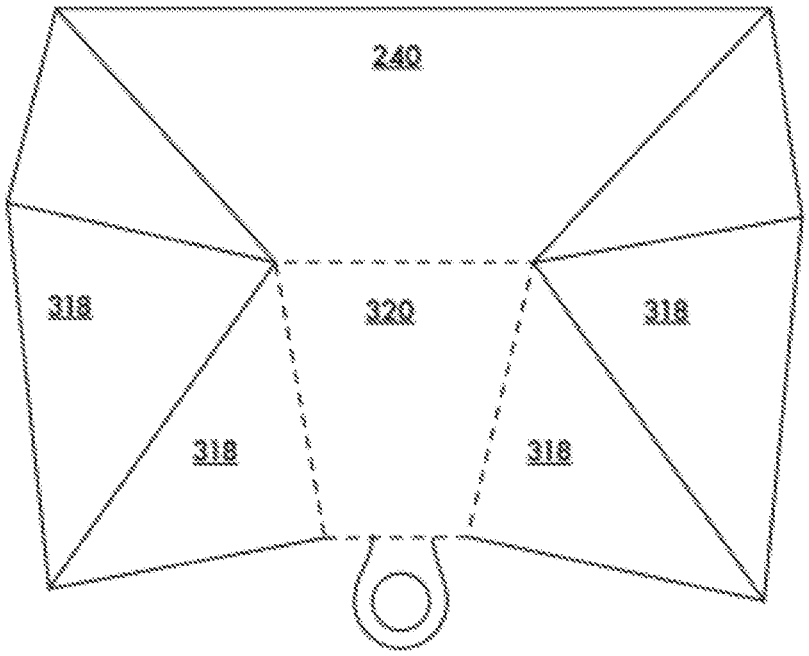
Figure 21C:
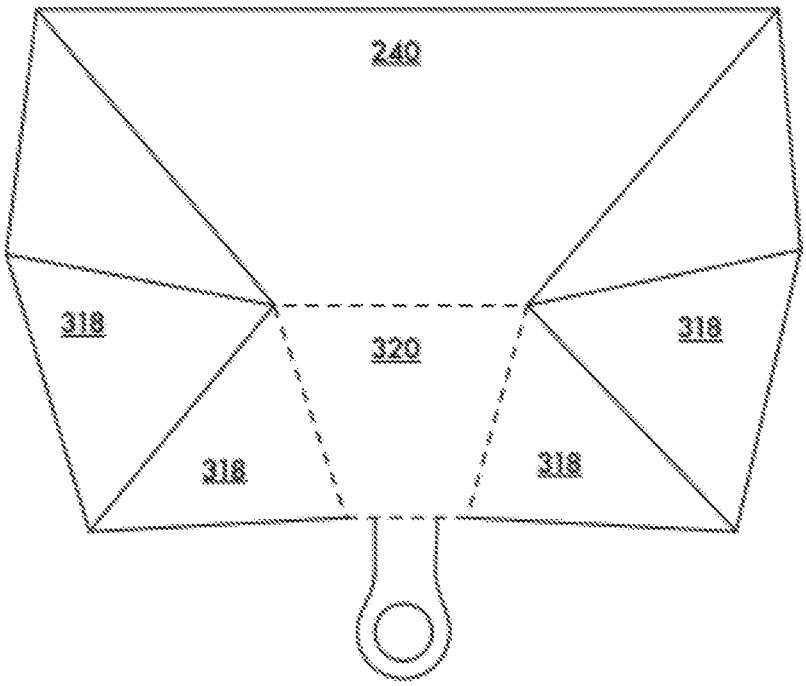
Figure 21D:
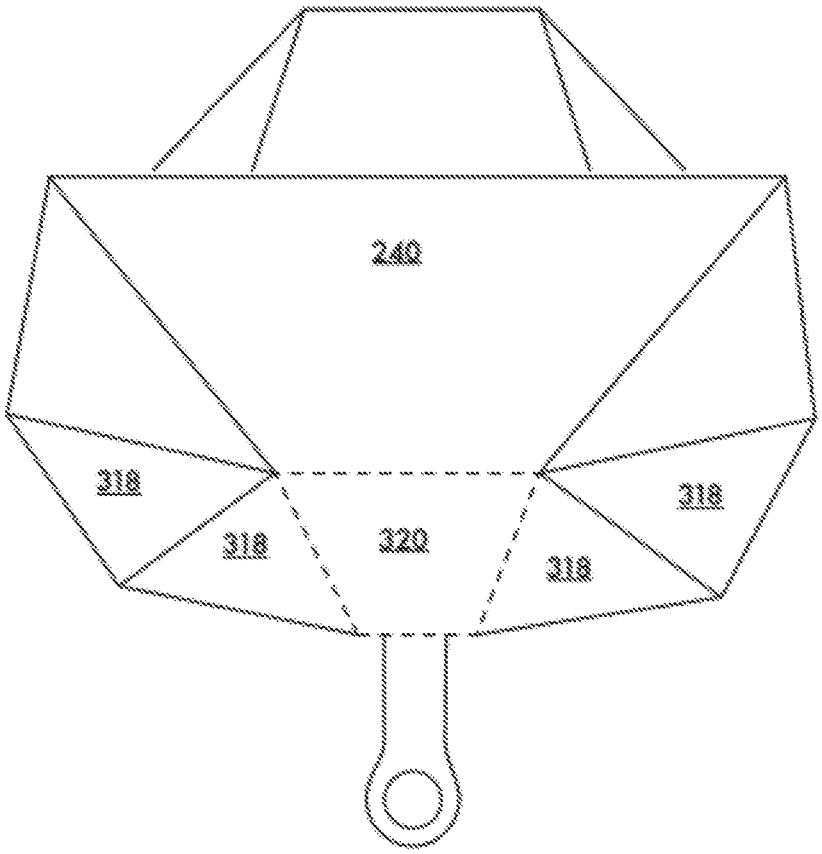

FIGS. 21B-21D are successive views as the booster seat is opened, showing trapezoid 320 folding outward and linking panels 318 bending inward to position the trapezoid in its load-bearing position.

Figure 21E:
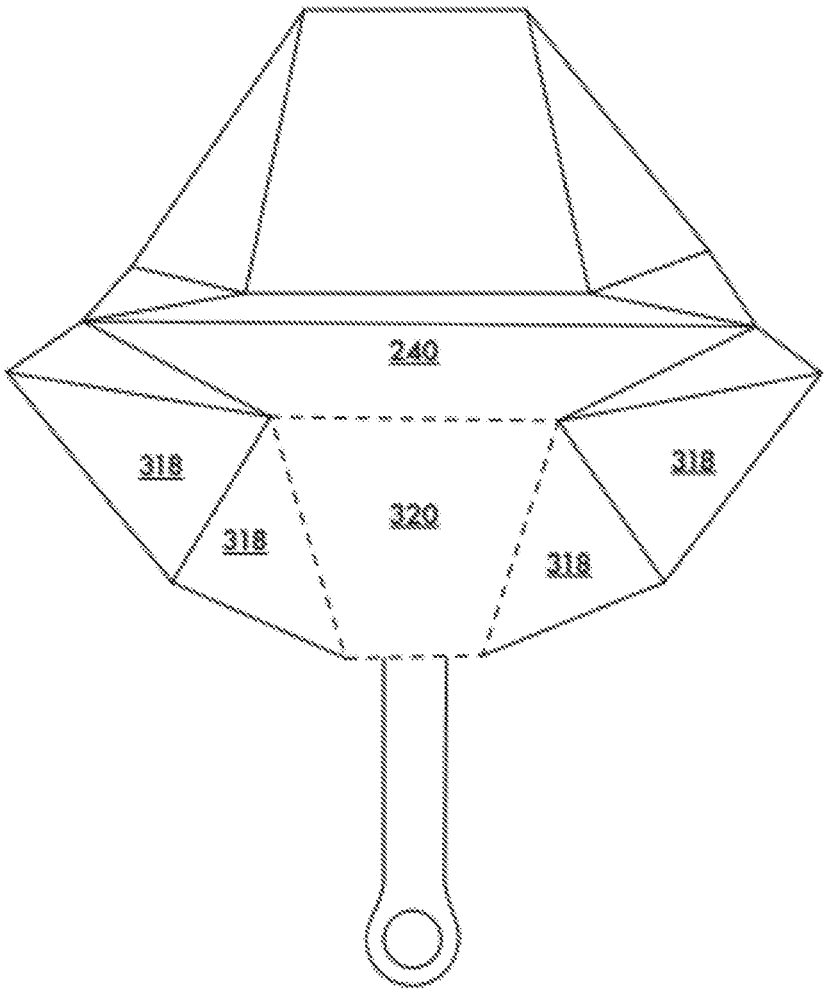

FIG. 21E shows load-bearing surface 240 extending in a lateral position with trapezoid 320 extending outward supported by linking panels 318.

Figure 22A:
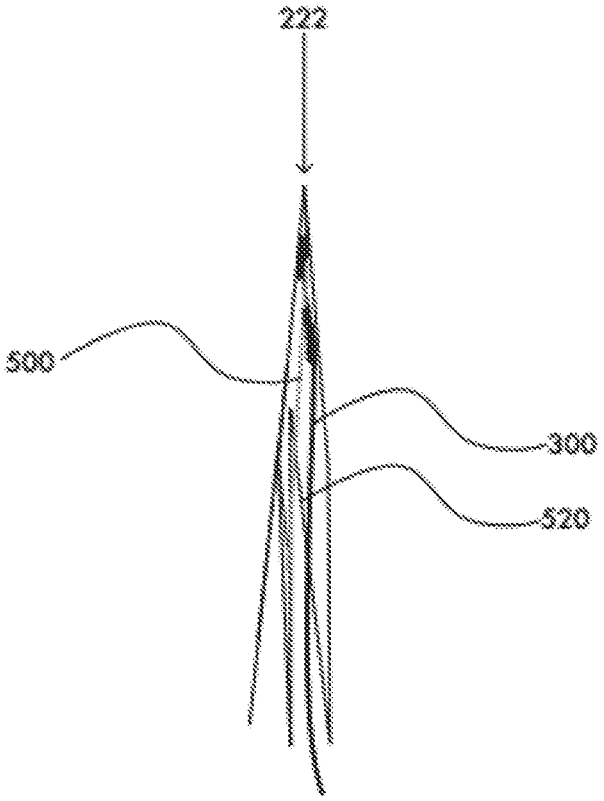

When used as a child booster seat, it may be desirable to add further structural reinforcement to the interior of the load-bearing structure. Further, an optional actuator may be included to assist in opening the pop-up structure by applying a pulling force to a central hinge. FIGS. 22A-22F depict a cutaway side view showing optional internal strengthening components. FIG. 22A depicts a central hinge 222. Beneath the hinge, optional actuator 300 is attached such that pulling on actuator 300 opens the support structure. Also seen in FIG. 22A is a cross-brace 500 and a folded angular brace 520. Folded angular brace includes an internal cut-out portion that accommodates the cross-brace 500. That is, in the assembled position, the cross-brace 500 will be supported by a portion of the angular brace 520.

Figure 22B:
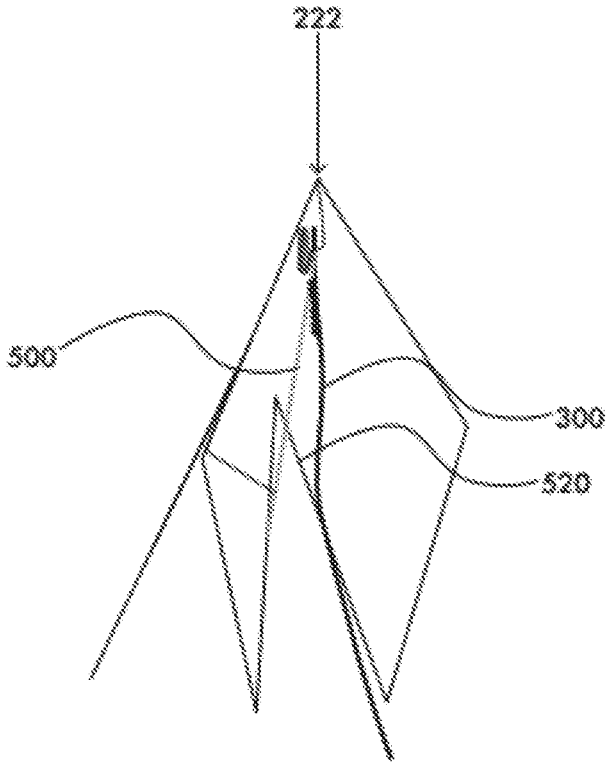
Figure 22C:
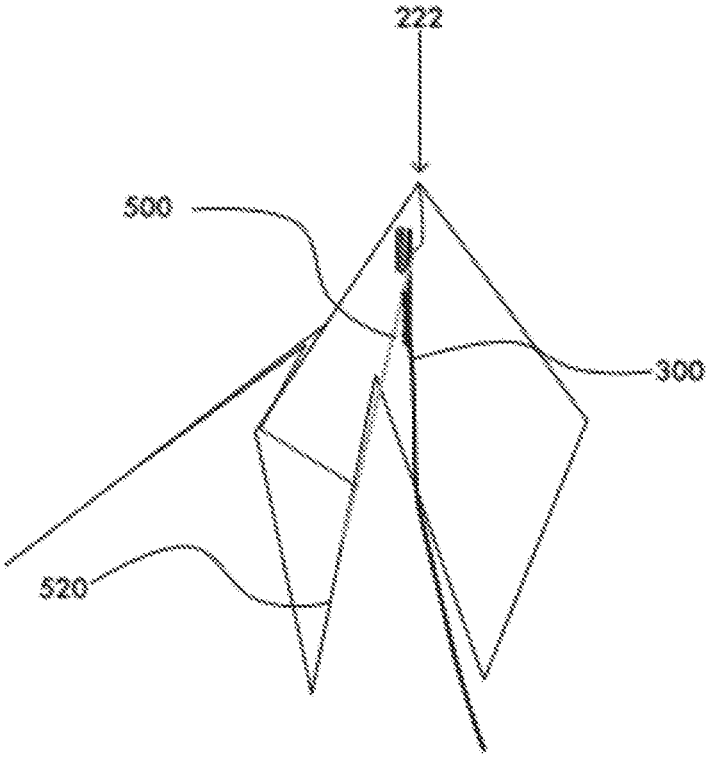

As the child booster seat opens, as seen in FIGS. 22B and 22C, folded angular brace 520 also begins to open as cross-brace 500 begins to lower. Optionally, as shown in FIGS. 22A-22F, the actuator 300 is a strap that passes through cross-brace 500, pulling it down toward a lateral position as the booster seat opens up.

Figure 22D:
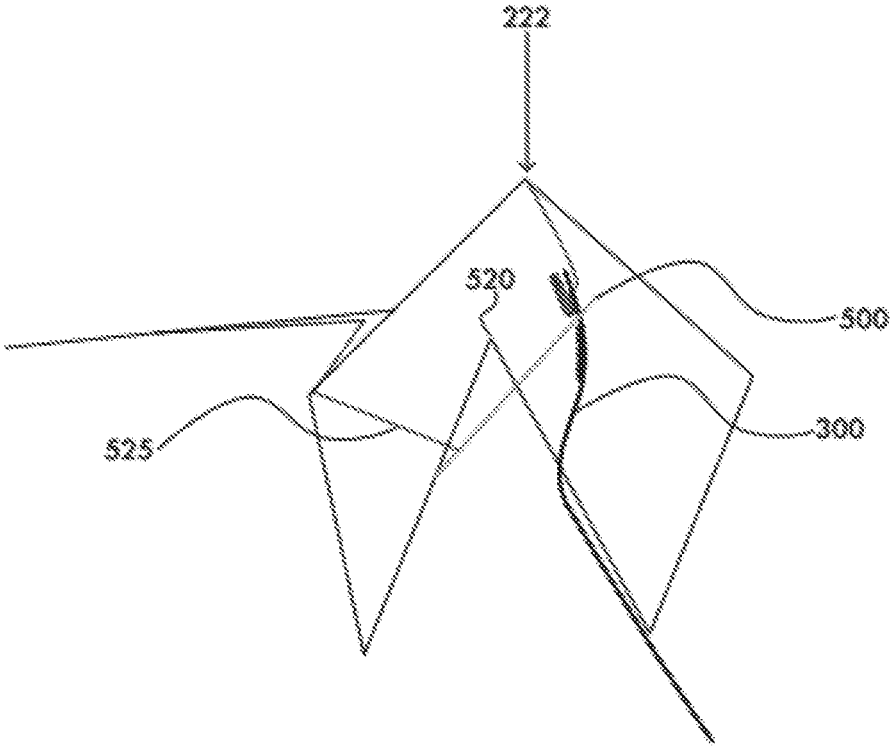
Figure 22E:
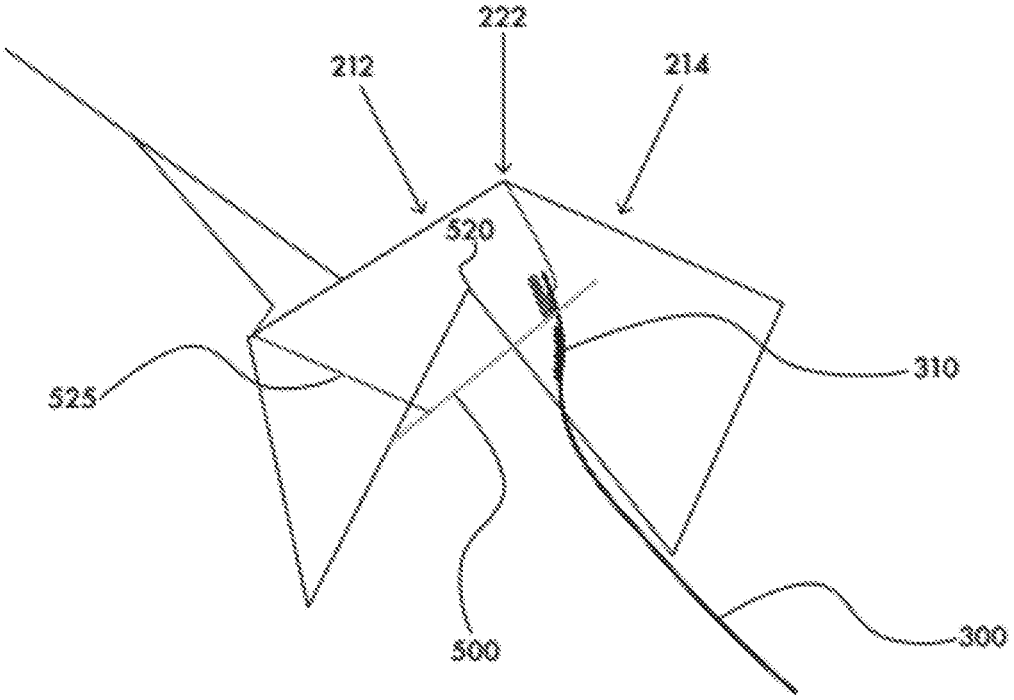
Figure 22F:
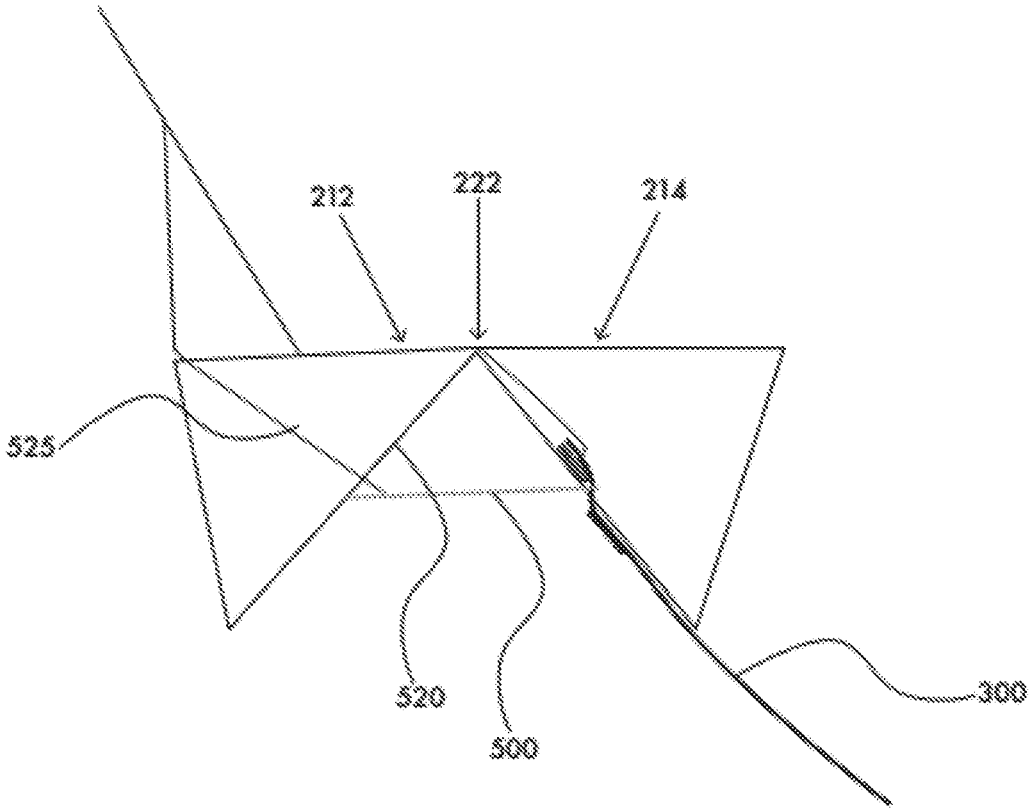

Turning to FIG. 22D, it can be seen that the cross-brace 500 may be further held in position by optional anchor strap 525 that is connected to one of the panels of the booster seat. FIG. 22E depicts a nearly-open booster seat structure, with panels 212 and 214 nearly open to form the load-bearing surface. Cross-brace 500 has been pulled by actuator 300 towards a lateral position within the angular brace 520. FIG. 22F depicts the fully-open and assembled booster seat in cross-section with cross-brace 500 in the lateral position and its optional anchor strap 525 pulled taut. The angular brace 520 supports the load-bearing surface formed by panels 212 and 214. Hinge 222 is completely open.

Note that a variety of internal supports may be configured to provide additional support to the load-bearing surface and that the assembly shown in FIGS. 22A-22F are only examples of the types of supports that may be used. For example, the angular brace 520 may be used without the cross-brace 500. Further, applying force from the top of the structure at hinge 222, for example, application of manual force, may also be used to open the pop-up structure.

FIG. 23 depicts an optional actuator 300 that may be used with the self-assembling child booster seat. In the embodiment of FIG. 22, the actuator is a pull-strap that include ratchets 310 (seen in profile in FIG. 22E). The strap 300 is linked at one end to flexible hinge 222 (FIG. 20A) and passes through a lock mechanism 420 that engages the ratchets. The lock mechanism includes a projection, not visible, that engages the ratchets 310 on the strap 300. Pressing in release tabs 430 (FIG. 23) disengages the lock projection, releasing the ratchet strap. Thus, when a user pulls on the strap, the child booster seat "pops-up" from a folded configuration to a fully-assembled configuration without any assembly required by the user. Note that the actuator is completely optional; the folded configuration may be manually manipulated through pressure on the foldable hinges to a fully-assembled state. A further optional internal support may be included as seen in FIG. 23; strap 600 may link the hinges of the side support triangular structure to resist deformation under a load.

FIG. 23 additionally shows support brace 500 in the assembled, lateral position, and angular brace 520 assembled to further support the load-bearing surface.

The foregoing description of the present invention has been provided for the purposes of illustration and description. It is not intended to be exhaustive or to limit the invention to the precise forms disclosed. Many modifications and variations will be apparent to the practitioner skilled in the art.

The embodiments were chosen and described in order to best explain the principles of the invention and its practical application, thereby enabling others skilled in the art to understand the invention for various embodiments and with various modifications that are suited to the particular use contemplated.

The invention claimed is:

1. A collapsible, load-bearing structure for self-assembling, pop-up structures that self-assembles from a folded, collapsed configuration to an assembled, three-dimensional configuration comprising:

a first collapsible structure having a collapsible quadrilateral shape in cross-section with four quadrilateral sides, each quadrilateral side rotatably connected to an adjacent quadrilateral side, the length of the quadrilateral sides configured such that the quadrilateral shape is reconfigurable into a structure having an approximately triangular shape in the cross-section, with two adjacent quadrilateral sides being rotated to form a single side of the approximately triangular shape, the single side forming a load-bearing surface;

a support structure for the load-bearing surface including two foldable supports sharing a common side rotatably connected, each of the two foldable supports rotatably attached to one quadrilateral side such that folding of the collapsible quadrilateral shape to a collapsed state causes the two foldable supports to fold together facing each other;

wherein configuring the quadrilateral shape into the approximately triangular shape causes the load bearing surface to be upheld by the unfolded foldable supports and wherein the approximately triangular shape formed from the quadrilateral shape includes a vertex opposite the single side forming the load-bearing surface, the vertex pointing away from the single side forming the load-bearing surface.

2. The collapsible, load-bearing structure for self-assembling, pop-up structures according to claim 1, wherein the two foldable supports are each a triangular support.

3. The collapsible, load-bearing structure for self-assembling, pop-up structures according to claim 1, further comprising an actuator to apply force to a portion of the load-bearing structure to assemble the structure from a folded, collapsed state, to an assembled, load-bearing state.

4. The collapsible, load-bearing structure for self-assembling, pop-up structures according to claim 3, wherein the actuator is a pullable ratchet strip.

5. The collapsible, load-bearing structure for self-assembling, pop-up structures according to claim 4, further comprising a releasable lock for engaging and disengaging the pullable ratchet strip.

6. The collapsible, load-bearing structure for self-assembling, pop-up structures according to claim 1, further comprising a quadrilateral support shape supporting the first collapsible quadrilateral structure.

7. The collapsible, load-bearing structure for self-assembling, pop-up structures according to claim 6, further comprising one more linking panels connecting the quadrilateral support shape to one of the foldable supports.

8. The collapsible, load-bearing structure for self-assembling, pop-up structures according to claim 7, wherein the quadrilateral support shape is a trapezoid.

9. The collapsible, load-bearing structure for self-assembling, pop-up structures according to claim 6, wherein the quadrilateral support shape is rotatably connected on one side to the load-bearing surface.

10. A child booster seat including the collapsible, load-bearing structure for self-assembling, pop-up structures according to claim 1.

11. A collapsible, load-bearing structure for self-assembling, pop-up structures that self-assembles from a folded, collapsed configuration to an assembled, three-dimensional configuration comprising:

a first foldable structure comprising first and second load-bearing surfaces rotatably connected along a hinge such that the first and second load-bearing surfaces fold together in a first, substantially flat configuration, and open to form a single load-bearing surface;

each of the first and second load-bearing surfaces respectively connected by a hinge to first and second support quadrilaterals;

each support quadrilateral being rotatably connected by a hinge on two quadrilateral sides to one or more triangular-shaped linking panels, at least one of the one or more triangular-shaped linking panels including an edge configured to rest on a support surface;

at least one of the linking panels being rotatably connected by a hinge to a respective side support for the first and second load-bearing surfaces, wherein the side support is a triangular-shaped side support having a triangle vertex pointing away from the first and second load-bearing surfaces and a support edge supporting at least one of the first and second load-bearing surfaces.

12. The collapsible, load-bearing structure for self-assembling, pop-up structures that assembles from a folded, collapsed configuration to an assembled, three-dimensional configuration according to claim 11, wherein each of the support quadrilaterals is a trapezoid.

13. The collapsible, load-bearing structure for self-assembling, pop-up structures that assembles from a folded, collapsed configuration to an assembled, three-dimensional configuration according to claim 11, wherein the one or more triangular-shaped linking panels comprises two triangular-shaped linking panels on each side of each support quadrilateral rotatably linked to one another and to the triangular-shaped side support.

14. The collapsible, load-bearing structure for self-assembling, pop-up structures that assembles from a folded, collapsed configuration to an assembled, three-dimensional configuration according to claim 13, further comprising a second triangular-shaped side support on each side, wherein the triangular-shaped side support and the second triangular-shaped side support are rotatably connected to each other and are foldable to face each other when the structure is in a collapsed, folded state.

15. The collapsible, load-bearing structure for self-assembling, pop-up structures according to claim 11, further comprising an actuator to apply force to a portion of the load-bearing structure to assemble the structure from a folded, collapsed state, to an assembled, load-bearing state.

16. The collapsible, load-bearing structure for self-assembling, pop-up structures according to claim 15, wherein the actuator is a pullable ratchet strip.

17. The collapsible, load-bearing structure for self-assembling, pop-up structures according to claim 16, further comprising a releasable lock for engaging and disengaging the pullable ratchet strip.

18. The collapsible, load-bearing structure for self-assembling, pop-up structures according to claim 16, further comprising a foldable internal support structure for supporting the single load-bearing surface.

19. A child booster seat including the collapsible, load-bearing structure for self-assembling, pop-up structures according to claim 11.

* * * * *